US006390890B1

(12) United States Patent
Molnar

(10) Patent No.: US 6,390,890 B1
(45) Date of Patent: May 21, 2002

(54) FINISHING SEMICONDUCTOR WAFERS WITH A FIXED ABRASIVE FINISHING ELEMENT

(76) Inventor: Charles J Molnar, 12 Malvern Ct., Wilmington, DE (US) 19810

( * ) Notice: Subject to any disclaimer, the term of this patent is extended or adjusted under 35 U.S.C. 154(b) by 0 days.

(21) Appl. No.: 09/498,265

(22) Filed: Feb. 3, 2000

Related U.S. Application Data

(60) Provisional application No. 60/118,967, filed on Feb. 6, 1999.

(51) Int. Cl.[7] ..... B24B 1/00

(52) U.S. Cl. ..... 451/41; 451/285; 451/290; 451/527; 451/921

(58) Field of Search ..... 451/41, 527, 530, 451/290, 534, 921; 438/692, 693, 645; 252/79.4; 156/636.1, 345; 51/298; 523/206, 216; 524/425, 492, 430

(56) References Cited

U.S. PATENT DOCUMENTS

| | | | | |
|---|---|---|---|---|
| 3,925,034 A | * | 12/1975 | Anna et al. | 451/527 |
| 4,548,617 A | * | 10/1985 | Miyatani et al. | 451/36 |
| 4,575,396 A | * | 3/1986 | Matsumoto et al. | 134/7 |
| 5,096,854 A | | 3/1992 | Saito | |
| 5,197,999 A | | 3/1993 | Thomas | |
| 5,212,910 A | | 5/1993 | Breivogel et al. | |
| 5,230,184 A | | 7/1993 | Bukhman | |
| 5,325,639 A | * | 7/1994 | Kuboyama et al. | 451/38 |
| 5,389,032 A | | 2/1995 | Beardsley | |
| 5,394,655 A | | 3/1995 | Allen et al. | |
| 5,441,598 A | | 8/1995 | Yu et al. | |
| 5,476,416 A | * | 12/1995 | Kodate | 451/526 |
| 5,514,245 A | | 5/1996 | Doan et al. | |
| 5,533,923 A | | 7/1996 | Shamouillian et al. | |
| 5,534,106 A | | 7/1996 | Cote et al. | |
| 5,558,563 A | | 9/1996 | Cote et al. | |
| 5,575,707 A | | 11/1996 | Talieh | |

(List continued on next page.)

FOREIGN PATENT DOCUMENTS

| | | |
|---|---|---|
| WO | WO 98/08919 | 3/1998 |
| WO | WO 98/45087 | 10/1998 |
| WO | WO 98/47662 | 10/1998 |
| WO | WO 98/50201 | 11/1998 |
| WO | WO 99/07518 | 2/1999 |
| WO | WO 00/02707 | 1/2000 |
| WO | WO 00/02708 | 1/2000 |

OTHER PUBLICATIONS

"New materials and processes for CMP: Solving the local planarity–global uniformity tradeoff", OMB approval No.: 0693–0009, Competition No.:98–06, Apr. 7, 1998.

*Primary Examiner*—George Nguyen

(57) ABSTRACT

A fixed abrasive finishing element having a continuous phase of synthetic resin and discrete synthetic resin particles dispersed in the continuous phase of synthetic resin is described. The synthetic resin particles have abrasive particles dispersed therein. A compatibilizing agent can be used to enhance their finishing properties. The finishing elements are useful for polishing semiconductor wafers. Planarization and localized finishing can be improved using these finishing elements. Unwanted surface defects can be reduced. Methods to finish a semiconductor wafer using these finishing elements are described.

27 Claims, 5 Drawing Sheets

U.S. PATENT DOCUMENTS 5,578,362 A 11/1996 Reinhardt et al.
5,593,537 A 1/1997 Cote et al.
5,607,488 A 3/1997 Wiand
5,609,517 A 3/1997 Lofaro
5,624,303 A 4/1997 Robinson
5,632,790 A 5/1997 Wiand
5,685,947 A 11/1997 Tseng et al.
5,692,950 A 12/1997 Rutherford et al.
5,702,290 A 12/1997 Leach
5,743,784 A 4/1998 Birang
5,769,691 A 6/1998 Fruitman
5,769,699 A 6/1998 Yu
5,795,218 A 8/1998 Doan et al.
5,820,450 A 10/1998 Calhoun
5,823,855 A 10/1998 Robinson
5,836,807 A 11/1998 Leach
5,876,266 A 3/1999 Miller
5,879,222 A 3/1999 Robinson
5,888,120 A 3/1999 Doran
5,899,745 A 5/1999 Kim et al.
5,900,164 A 5/1999 Budinger et al.
5,916,855 A 6/1999 Avanizino et al.
5,944,582 A 8/1999 Talieh
5,944,583 A 8/1999 Cruz et al.
5,951,380 A 9/1999 Kim
5,958,794 A 9/1999 Bruxvoort et al.
5,976,000 A * 11/1999 Hudson ..... 451/534
5,985,045 A 11/1999 Kobayashi
5,985,090 A 11/1999 Kikuta
5,990,244 A * 11/1999 Warakomski et al. ..... 525/179
5,993,298 A 11/1999 Duescher
6,007,407 A 12/1999 Rutherford
6,017,265 A 1/2000 Cook et al.
6,019,666 A 2/2000 Roberts et al.
6,022,264 A 2/2000 Cook et al.
6,022,268 A 2/2000 Roberts et al.
6,033,268 A 2/2000 Roberts et al.
6,069,080 A 5/2000 James et al.
6,071,178 A 6/2000 Baker, III
6,100,334 A * 8/2000 Abdou-Sabet ..... 525/191
6,121,143 A 9/2000 Messner et al.
6,126,532 A * 10/2000 Sevilla et al. ..... 451/526
6,234,875 B1 5/2001 Pendergrass, Jr.
6,267,644 B1 * 7/2001 Molnar ..... 451/41

* cited by examiner

FINISHING SEMICONDUCTOR WAFERS WITH A FIXED ABRASIVE FINISHING ELEMENT

This application claims the benefit of Provisional Application Ser. No. 60/118,967 filed on Feb. 6, 1999 entitled "Finishing semiconductor wafers with fixed abrasive finishing element" and this provisional application is included herein by reference in its entirety.

BACKGROUND ART

Chemical mechanical polishing (CMP) is generally known in the art. For example, U.S. Pat. No. 5,177,908 to Tuttle issued in 1993 describes a finishing element for semiconductor wafers, having a face shaped to provide a constant, or nearly constant, surface contact rate to a workpiece such as a semiconductor wafer in order to effect improved planarity of the workpiece. U.S. Pat. No. 5,234,867 to Schultz et al. issued in 1993 describes an apparatus for planarizing semiconductor wafers which in a preferred form includes a rotatable platen for polishing a surface of the semiconductor wafer and a motor for rotating the platen and a non-circular pad is mounted atop the platen to engage and polish the surface of the semiconductor wafer. Fixed abrasive finishing elements are known for polishing. Illustrative examples include U.S. Pat. No. 4,966,245 to Callinan, U.S. Pat. No. 5,823,855 to Robinson, and WO 98/06541 to Rutherford.

An objective of polishing of semiconductor layers is to make the semiconductor layers as nearly perfect as possible. Current fixed abrasive finishing elements can suffer from being costly to manufacture. Also, current fixed abrasive finishing elements for semiconductor wafers have relatively homogenous surfaces which inherently limit their versatility in some demanding finishing applications. Still further, current fixed abrasive finishing elements do not have built into their construction a continuous phase of material on their surface which can help reinforce them and prolong their useful life while also improving manufacturability and versatility for finishing. Still further, lack of a continuous phase matrix on their surface reduces the flexibility to add finishing enhancers. Still further, a lack of the above characteristics in a finishing element reduces the versatility of the finishing method that can be employed for semiconductor wafer surface finishing. Still further, current fixed abrasive finishing pads are limited in the way they apply pressure to the abrasives and in turn against the semiconductor wafer surface being finished. These unwanted effects are particularly important and can be deleterious to yield and cost of manufacture when manufacturing electronic wafers that require extremely close tolerances in required planarity and feature sizes.

It is an advantage of this invention to improve the finishing method for semiconductor wafer surfaces to make them as perfect as possible. It is an advantage of this invention to make fixed abrasive finishing elements with a lower cost of manufacture and thus also reduce the cost of finishing a semiconductor wafer surface. It is an advantage of this invention develop a heterogeneous fixed abrasive finishing element surface having a continuous phase synthetic resin matrix to improve the versatility of the finishing elements and the methods of finishing semiconductor wafers which result. It is also an advantage of the invention to develop fixed abrasive finishing element which is reinforced with a continuous phase synthetic resin matrix. It is further an advantage of the invention to develop a fixed abrasive finishing element having a continuous phase synthetic resin matrix which can include finishing enhancers such as finishing aids. It is an advantage of the invention to develop a finishing element which has a unique way of applying pressure to the fixed abrasive elements and to the workpiece surface being finished. It is further an advantage of this invention to help improve yield and lower the cost of manufacture for finishing of workpieces having extremely close tolerances such as semiconductor wafers.

These and other advantages of the invention will become readily apparent to those of ordinary skill in the art after reading the following disclosure of the invention.

BRIEF DESCRIPTION OF DRAWING FIGURES

REFERENCE NUMERALS IN DRAWINGS

Figure 1:
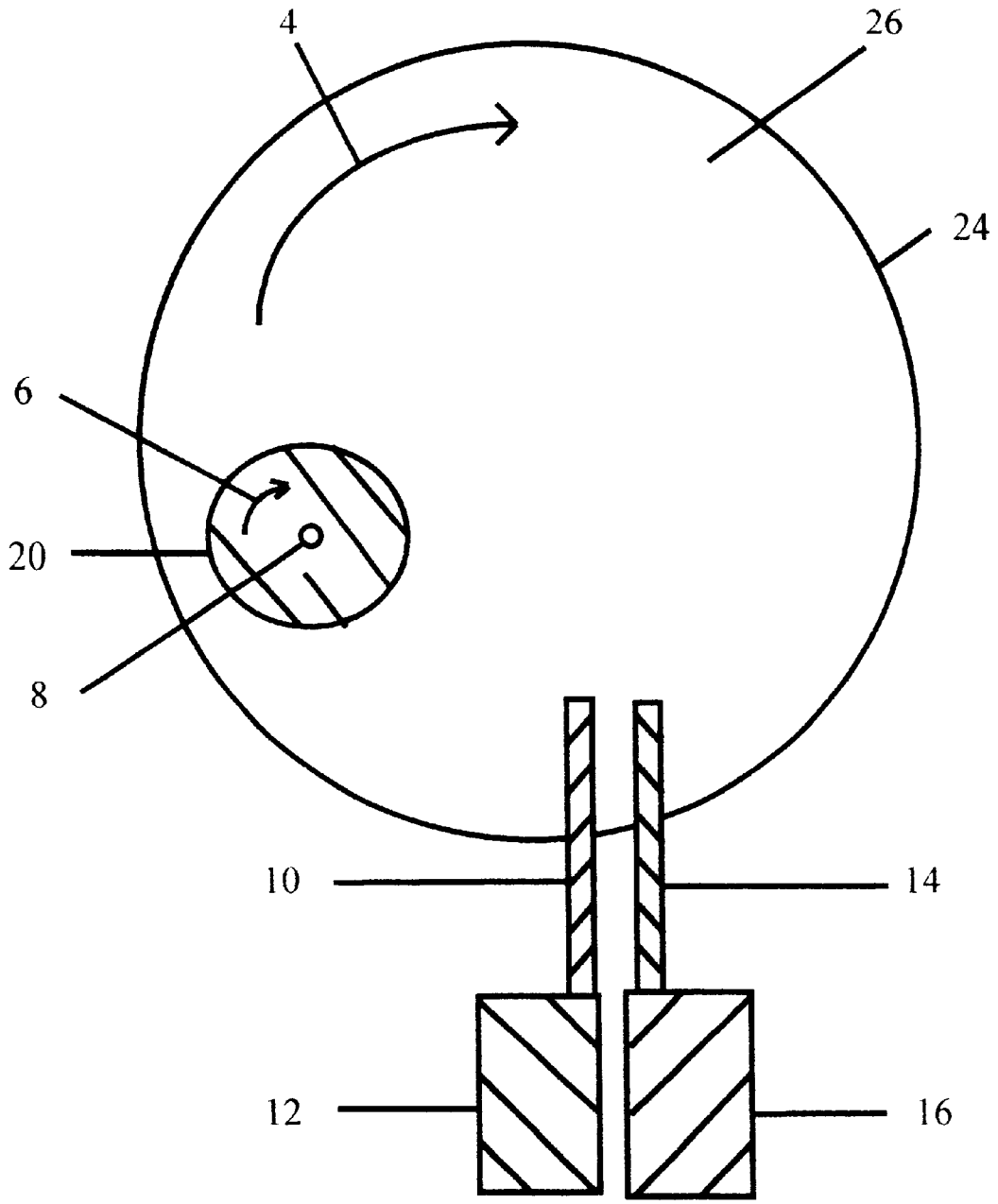
FIG. 1 is an artist's drawing of the interrelationships of the different materials when finishing according to this invention.

Reference Numeral 4 direction of rotation of the finishing element finishing surface
Reference Numeral 6 direction of rotation of the workpiece being finished
Reference Numeral 8 center of the rotation of the workpiece
Reference Numeral 10 finishing composition feed line for adding finishing chemicals
Reference Numeral 12 reservoir of finishing composition
Reference Numeral 14 alternate finishing composition feed line for adding alternate finishing chemicals
Reference Numeral 16 a reservoir of alternate finishing composition
Reference Numeral 17 rotating carrier for the workpiece
Reference Numeral 18 operative contact element
Reference Numeral 20 workpiece
Reference Numeral 21 workpiece surface facing away from the workpiece surface being finished.
Reference Numeral 22 surface of the workpiece being finished
Reference Numeral 23 raised surface perturbation
Reference Numeral 24 abrasive finishing element
Reference Numeral 26 finishing element finishing surface.
Reference Numeral 28 finishing element surface facing away from workpiece surface being finished
Reference Numeral 30 finishing composition
Reference Numeral 32 operative finishing motion
Reference Numeral 33 finishing element surface layer
Reference Numeral 34 synthetic resin particles
Reference Numeral 35 abrasive particles
Reference Numeral 36 continuous phase synthetic resin matrix
Reference Numeral 37 finishing element subsurface layer
Reference Numeral 38 optional finishing aids
Reference Numeral 40 platen
Reference Numeral 42 surface of the platen facing the finishing element
Reference Numeral 44 surface of the platen facing away from the finishing element Reference Numeral 54 base support structure
Reference Numeral 56 surface of the base support structure facing the platen
Reference Numeral 60 carrier housing
Reference Numeral 62 pressure distributive element
Reference Numeral 100 optional discrete stiffening member
Reference Numeral 102 spacing between the adjacent discrete stiffening members
Reference Numeral 110 discrete stiffened region
Reference Numeral 112 unstiffened region

SUMMARY OF INVENTION

A preferred embodiment of this invention is directed to a method of finishing a semiconductor wafer comprising the step a) of providing a fixed abrasive finishing element having a finishing element surface layer with an abrasive finishing surface and wherein the finishing element surface layer comprises a continuous phase comprising a synthetic resin matrix comprising synthetic resin polymer "A"; and discrete synthetic resin particles comprising synthetic resin "B" and having a plurality of abrasive particles dispersed therein, the discrete synthetic resin particles being dispersed in the continuous phase of synthetic resin polymer "A"; and synthetic resin polymer "A" having a different Shore D hardness from synthetic resin polymer "B"; and the fixed abrasive-finishing element further having a finishing element subsurface layer free of discrete synthetic resin polymer "B" particles having abrasive particles dispersed therein; a step b) of positioning the semiconductor wafer surface being finished proximate to the fixed abrasive finishing surface; and a step c) of applying an operative finishing motion between the semiconductor wafer surface being finished and the abrasive finishing surface wherein both the continuous phase of synthetic resin polymer "A" and the synthetic resin particles are in pressurized contact with the semiconductor wafer surface being finished.

A preferred embodiment of this invention is directed to a finishing element having a synthetic resin layer for finishing a semiconductor wafer comprising a continuous phase comprising a synthetic resin matrix comprising synthetic resin polymer composition "A"; and discrete synthetic resin particles comprising synthetic resin polymer composition "B" having abrasive particles therein; the discrete. synthetic resin particles being dispersed in the continuous phase of synthetic resin polymer "A"; and a polymeric compatibilizing agent "C" for compatibilizing the polymer composition "A" and the polymer composition "B"; and wherein the Shore D hardness of the synthetic resin polymer "A" in the discrete synthetic resin particle is different than the Shore D hardness of the synthetic resin polymer "B".

Another preferred embodiment of this invention is directed a process for making an abrasive finishing element component comprising the step 1) of supplying a synthetic resin "A", a synthetic resin "B", abrasive particles, and a polymeric compatibilizer "C" to a melt mixer, the step 2) of dynamically melt mixing and dispersing the synthetic resin "B" into the synthetic resin "A" forming a multiphase polymeric mixture having dispersed abrasive particles therein, and the step 3) of melt forming a finishing element component for finishing a semiconductor wafer.

Another preferred embodiment of this invention is directed a process. A method of finishing a semiconductor wafer comprising the step 1) of providing a finishing element having an abrasive finishing element surface layer and wherein the finishing element surface layer comprises a continuous phase comprising a thermoplastic polymer "A"; and crosslinked discrete synthetic resin particles comprising synthetic resin "B", the discrete synthetic resin particles having abrasive particles dispersed therein; the step 2) of positioning the semiconductor wafer surface being finished proximate to the fixed abrasive finishing surface; and the step 3) of applying an operative finishing motion between the semiconductor wafer surface being finished and the abrasive finishing surface wherein both the continuous phase of polymer "A" and the synthetic resin particles are in pressurized contact with the semiconductor wafer surface being finished; and wherein the continuous phase of polymer "A" undergoes plastic deformation and the crosslinked discrete synthetic resin "B" particles undergo elastic deformation.

These and other embodiments are more fully described in the Detailed Description.

DETAILED DESCRIPTION OF PREFERRED EMBODIMENTS OF THE INVENTION

The book *Chemical Mechanical Planarization of Microelectric Materials* by Steigerwald, J. M. et al. published by John Wiley & Sons, ISBN 0471138274, generally describes chemical mechanical finishing and is included herein by reference in its entirety for general background. In chemical mechanical finishing the workpiece is generally separated from the finishing element by a polishing slurry. The workpiece surface being finished is in parallel motion with finishing element finishing surface disposed towards the workpiece surface being finished. The abrasive particles such as are found in a polishing slurry are interposed between these surfaces are used to finish the workpiece in the background arts.

Discussion of some of the terms useful to aid in understanding this invention is now presented. Finishing is a term used herein for both planarizing and polishing. Planarizing is the process of making a surface which has raised surface perturbations or cupped lower areas into a planar surface and, thus involves reducing or eliminating the raised surface perturbations and cupped lower areas. Planarizing changes the topography of the work piece from non planar to ideally perfectly planar. Polishing is the process of smoothing or polishing the surface of an object and tends to follow the topography of the workpiece surface being polished. A finishing element is a term used herein to describe a pad or element for both polishing and planarizing. A finishing element finishing surface is a term used herein for a finishing element surface used for both polishing and planarizing. A finishing element planarizing surface is a term used herein for a finishing element surface used for planarizing. A finishing element polishing surface is a term used herein for a finishing element surface used for polishing. Workpiece surface being finished is a term used herein for a workpiece surface undergoing either or both polishing and planarizing. A workpiece surface being planarized is a workpiece surface undergoing planarizing. A workpiece surface being polished is a workpiece surface undergoing polishing. The finishing cycle time is the elapsed time in minutes that the workpiece is being finished. A portion of a finishing cycle time is about 5% to 95% of the total finishing cycle time in minutes and a more preferred portion of a finishing cycle time is 10% to 90% of the total finishing cycle time in minutes. The planarizing cycle time is the elapsed time in minutes that the workpiece is being planarized. The polishing cycle time is the elapsed time in minutes that the workpiece is being polishing.

As used herein, the term "polymer" refers to a polymeric compound prepared by polymerizing monomers whether the same or of a different type. The "polymer" includes the term homopolymer, usually used to refer to polymers prepared from the same type of monomer, and the term interpolymer as defined below.

As used herein, the term "interpolymer" referes to polymers prepared by polymerization of at least two different types of monomers.

As used herein, an emulsion is a fluid containing a microscopically heterogeneous mixture of two (2) normally immiscible liquid phases, in which one liquid forms minute droplets suspended in the other liquid. As used herein, a surfactant is a surface active substance, i.e., one which alters (usually reduces) the surface tension of water. Non limiting examples of surfactants include ionic, nonionic, and cationic. As used herein, a lubricant is an agent that reduces friction between moving surfaces. A hydrocarbon oil is a non limiting example. As used herein, soluble means capable of mixing with a liquid (dissolving) to form a homogeneous mixture (solution).

As used herein, a dispersion is a fluid containing a microscopically heterogeneous mixture of solid phase material dispersed in a liquid in which the solid phase material is in minute particles suspended in the liquid. As used herein, a surfactant is a surface active substance, i. e., alters (usually reduces) the surface tension of water. Non limiting examples of surfactants include ionic, nonionic, and cationic. As used herein, a lubricant is an agent that reduces friction between moving surfaces. As used herein, soluble means capable of mixing with a liquid (dissolving) to form a homogeneous mixture (solution).

As used herein, a die is one unit on a semiconductor wafer generally separated from its neighbor scribe lines. After the semiconductor wafer fabrication steps are completed, the die are generally separated into units by sawing. The separated units are generally referred to as "chips". Each semiconductor wafer generally has many die which are generally rectangular. The terminology semiconductor wafer and die are generally known to those skilled in the arts. As used herein, within die uniformity refers to the uniformity within the die. As used herein, local planarity refers to die planarity unless specifically defined otherwise. Within wafer uniformity refers to the uniformity of finishing of the wafer. As used herein, wafer planarity refers to planarity across a wafer. Multiple die planarity is the planarity across a defined number of die. As used herein, global wafer planarity refers to planarity across the entire semiconductor wafer planarity. Planarity is important for the photolithography step generally common to semiconductor wafer processing, particularly where feature sizes are less than 0.25 microns. As used herein, a device is a discrete circuit such as a transistor, resistor, or capacitor. As used herein, pattern density is ratio of the raised (up) area in square millimeters to the to area in square millimeters of region on a specific region such as a die or semiconductor wafer. As used herein, pattern density is ratio of the raised (up) area in square millimeters to the total area in square millimeters of region on a specific region such as a die or semiconductor wafer. As used herein, line pattern density is the ratio of the line width to the pitch. As used herein, pitch is line width plus the oxide space. As an illustrative example, pitch is the copper line width plus the oxide spacing. Oxide pattern density, as used herein, is the volume fraction of the oxide within an infinitesimally thin surface of the die.

As used herein, a multiphase polymeric mixture is mixture of two or more polymers which form two different and distinct polymeric regions in the mixture. Where the two distinct polymers have different glass transition temperatures, the multiphase polymeric mixture will have more than one glass transition temperature. A continuous phase region of polymer "A" in the mixture is a region which remains continuous in polymer "A" from one point to another point (generally from one end of the part to the other end of the part). A discrete phase region of polymer "B" is a region which is distinct and separated from nearest neighbor of polymer "B". As a further example, a multiphase polymeric mixture can have a continuous phase of polymer "A" having a glass transition temperature of 150 degrees centigrade having a plurality of distinct, separated droplets of polymer "B" having glass transition temperature of 60 degrees centigrade. This multiphase mixture would have two distinct and separate glass transition temperatures.

As used herein, vulcanizing is the process of crosslinking a polymer or interpolymer or elastomer.

As used herein, dynamic crosslinking is the process of crosslinking an elastomer (or polymer) during intimate melt mixing with a noncrosslinking thermoplastic polymer. As used herein, a crosslinked polymer is an polymer wherein at least 10% by weight of the polymer will not dissolve in a solvent which will dissolve the uncrosslinked at identical conditions and at atmospheric pressure.

Dynamic vulcanizing is the process of vulcanizing an elastomer or polymer during intimate melt mixing with a noncrosslinking thermoplastic polymer. As used herein, a fully vulcanized elastomer (or polymer) is an elastomer wherein less than 10% by weight of the total elastomer weight will dissolve in a solvent which will dissolve the unvulcanized elastomer (or polymer) at identical conditions and at atmospheric pressure.

A compatibilizing agent is a polymer which increases the compatibility of two immiscible polymers. A compatibilizing polymer is a preferred compatibilizing agent. The compatibilizing polymer "C" lowers the interfacial tension between the immiscible polymeric phases (of polymers "A" and "B") and generally increases the adhesion between the phases (of polymers "A" and "B"). As used herein, a polymeric compatibilizer is a polymer which increases the compatibility of two immiscible polymers. This multiphase mixture would generally have two distinct and separate glass transition temperatures.

As used herein, planarization length is defined as the width of a transition ramp at particular finishing conditions between a planarized "up" region and "low" region (in a die on a semiconductor wafer). An example is a high density region resulting in an "up" region and a low density region resulting in a "low" region on a die after planarization. The planarization length is similar to the interaction distance when polishing. Further details are given in "A closed-form analytic model for ILD thickness variation in CMP processes" by B. Stine, D. Ouma, R. Divecha, D. Boning, and J. Chung, Proc. CMP-MIC, Santa Clara, Calif., Febuary 1997 and "Wafer-Scale Modeling of pattern effect in oxide chemical mechanical polishing" by D. Ouma, B. Stine, R. Divecha, D. Boning, J. Chung, G. Shinn, I. Ali, and J. Clark in SPIE Microelectronics Manufacturing Conference, Microelectronic Device Session, Austin, Tex., October 1997 and both references are included in its entirety by reference for guidance.

Figure 2:
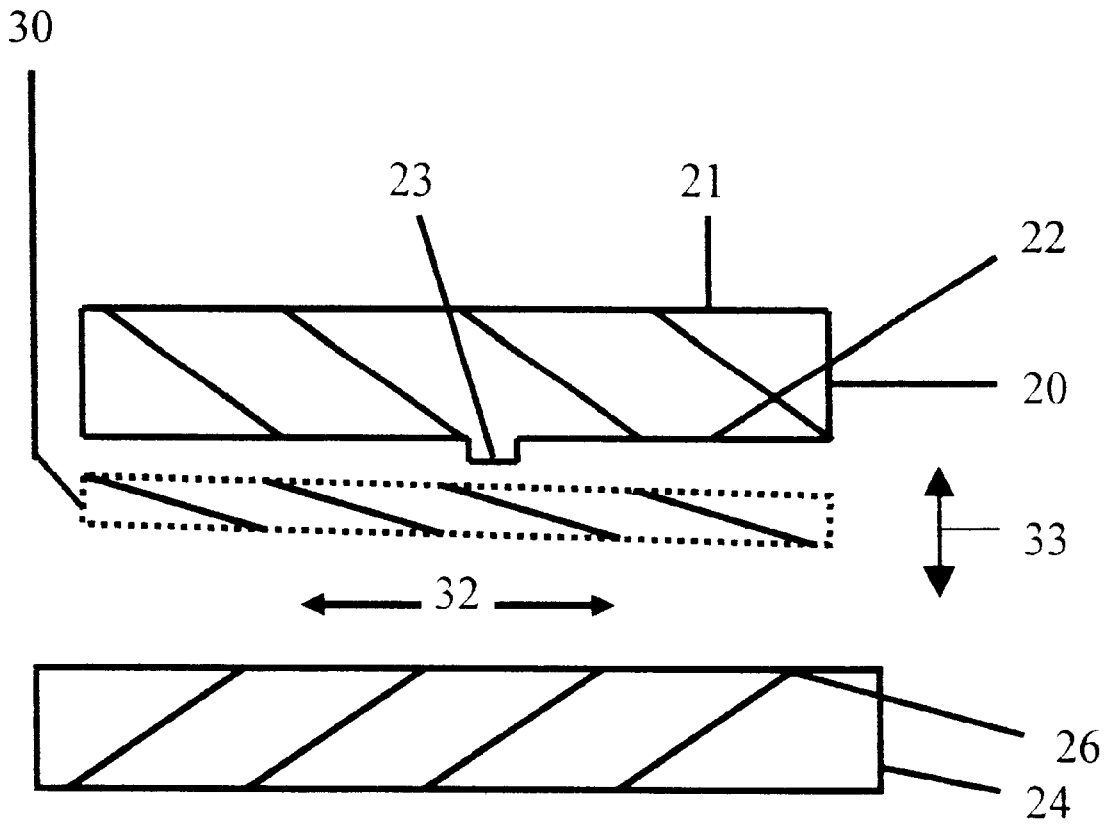
FIG. 2 is an artist's drawing of a particularly preferred embodiment of this invention including the interrelationships of the different objects when finishing according to this invention.
Figure 3:
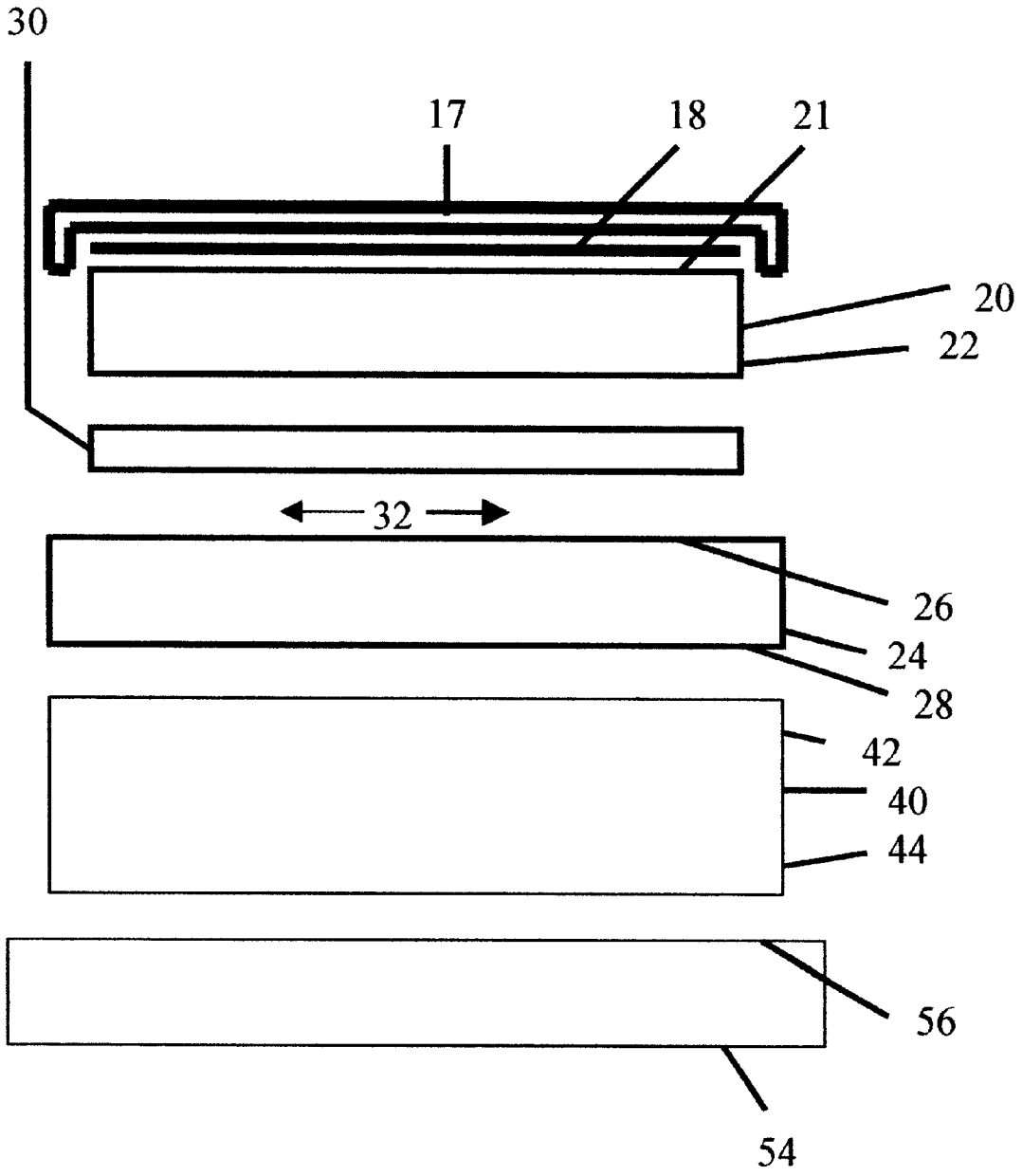
FIG. 3 is a closeup drawing of a preferred embodiment of this invention.

FIG. 1 is an artist's drawing of a particularly preferred embodiment of this invention when looking from a top down perspective including the interrelationships of some preferred objects when finishing according to the method of this invention. Reference Numeral 24 represents the abrasive finishing element. Reference Numeral 26 represents the abrasive finishing element finishing surface. Reference Numeral 4 represents the direction of rotation of the finishing element finishing surface. Reference Numeral 20 represents the workpiece being finished. The workpiece surface facing the finishing element finishing surface is the workpiece surface being finished. Reference Numeral 6 represents the direction of rotation of the workpiece being finished. Reference Numeral 8 is the center of the rotation of the workpiece. Reference Numeral 10 represents a finishing composition feed line for:adding other chemicals to the surface of the workpiece such as acids, bases, buffers, other chemical reagents, and the like. The finishing composition feed line can have a plurality of exit orifices. Reference Numeral 12 represents a reservoir of finishing composition to be fed to finishing element finishing surface. Not shown is the feed mechanism for the finishing composition such as a variable pressure or a pump mechanism. Reference Numeral 14 represents an alternate finishing composition feed line for adding a finishing chemical composition to the finishing element finishing surface to improve the quality of finishing. Reference Numeral 16 represents an alternate finishing composition reservoir of chemicals to be, optionally, fed to the finishing element finishing surface. Not shown is the feed mechanism for the alternate finishing composition such as a variable pressure or a pump mechanism. A preferred embodiment of this invention is to feed liquids from the finishing composition line and the alternate finishing composition feed line which are free of abrasive particles. Another preferred embodiment, not shown, is to have a wiping element, preferably an elastomeric wiping element, to uniformly distribute the finishing composition(s) across the finishing element finishing surface. Nonlimiting examples of some preferred dispensing systems and wiping elements is found in U.S. Pat. No. 5,709,593 to Guthrie et al., U.S. Pat. No. 5246,525 to Junichi, and U.S. Pat. No. 5,478,435 to Murphy et al. and are included herein by reference in their entirety for general guidance and appropriate modifications by those generally skilled in the art for supplying lubricating aids. FIGS. 2 and 3 will now provide an artists' expanded view of some relationships between the workpiece and the fixed abrasive finishing element.

FIG. 2 is an artist's closeup drawing of the interrelationships of some of the preferred aspects when finishing according to a preferred embodiment of this invention. Reference Numeral 20 represents the workpiece. Reference Numeral 21 represents the workpiece surface facing away from the workpiece surface being finished. Reference Numeral 22 represents the surface of the workpiece being finished. Reference Numeral 23 represents a high region on the workpiece surface being finished. During finishing, the high region is preferably substantially removed and more preferably, the high region is removed and surface polished. Reference Numeral 24 represents the abrasive finishing element. A fixed abrasive finishing element having a finishing aid comprising a polymeric lubricating aid at least partially dispersed therein is particularly preferred. Reference Numeral 26 represents the surface of the finishing element facing the workpiece and is often referred to herein as the finishing element finishing surface. An abrasive finishing surface is a preferred finishing element finishing surface and a fixed abrasive finishing surface is a more preferred finishing element finishing surface. Reference Numeral 30 represents a finishing composition and optionally, the alternate finishing composition is disposed between the workpiece surface being finished and finishing element finishing surface. The interface between the workpiece surface being finished and the finishing element finishing surface is often referred to herein as the operative finishing interface. A finishing composition comprising a water based composition is preferred. A finishing composition comprising a water based composition which is substantially free of abrasive particles is preferred. The workpiece surface being finished is in operative finishing motion relative to the finishing element finishing surface. An operative finishing motion is an example of a preferred finishing motion. Reference Numeral 32 represents a preferred operative finishing motion between the surface of the workpiece being finished and the finishing element finishing surface.

FIG. 3 is an artist's closeup drawing of a preferred embodiment of this invention showing some further interrelationships of the different objects when finishing according to the method of this invention. Reference Numeral 17 represents a carrier for the workpiece and in this particular embodiment, the carrier is a rotating carrier (optionally the carrier can be stationary). The rotating carrier is operable to rotate the workpiece against the finishing element which rests against the platen and optionally has a motor. Optionally, the rotating carrier can also be designed to move the workpiece laterally, in an arch, figure eight, or orbitally to enhance uniformity of polishing. The workpiece is in operative contact with the rotating carrier and optionally, has an operative contact element (Reference Numeral 18) to effect the operative contact. An illustrative example of an operative contact element is a workpiece held in place to the rotating carrier with a bonding agent (Reference Numeral 18). A hot wax is an illustrative example of a preferred bonding agent. Alternately, a porometric film can be placed in the rotating carrier having a recess for holding the workpiece. A wetted porometric film (Reference Numeral 18) will hold the workpiece in place by surface tension. An adherent thin film is another preferred example of placing the workpiece in operative contact with the rotating carrier. Reference Numeral 20 represents the workpiece. Reference Numeral 21 represents the workpiece surface facing away from the workpiece surface being finished. Reference Numeral 22 represents the surface of the workpiece being finished. Reference Numeral 24 represents the abrasive finishing element. Reference Numeral 26 represents the finishing element finishing surface. Reference Numeral 28 represents the surface of the finishing element facing away from the workpiece surface being finished. Reference Numeral 30 represents the finishing composition and optionally, the alternate finishing composition supplied between the workpiece surface being finished and surface of the finishing element facing the workpiece. For some applications the finishing composition and the alternate finishing composition can be combined into one feed stream, preferably free of abrasive particles. Reference Numeral 32 represents a preferred direction of the operative finishing motion between the surface of the workpiece being finished and the finishing element finishing surface. Reference Numeral 40 represents the platen or support for the finishing element. The platen can also have an operative finishing motion relative to the workpiece surface being finished. Reference Numeral 42 represents the surface of the platen facing the finishing element. The surface of the platen facing the finishing element is in support contact with the finishing element surface facing away from the workpiece surface being finished. The finishing element surface facing the platen can, optionally, be connected to the platen by adhesion. Frictional forces between the finishing element and the platen can also retain the finishing element against the platen. Reference Numeral 44 is the surface of the platen facing away from the finishing element. Reference Numeral 54 represents the base support structure. Reference Numeral 56 represents the surface of the base support structure facing the platen. The rotatable carrier (Reference Number 17) can be operatively connected to the base structure to permit improved control of pressure application at the workpiece surface being finished (Reference Numeral 22).

Current fixed abrasive finishing elements tend to have a higher cost of manufacture than necessary which in turn can lead to a higher cost to manufacture semiconductor wafers. A fixed abrasive finishing element having the new continuous phase synthetic resin matrix of this invention can be made on high speed thermoplastic processing equipment and at low cost (dynamic formation is a preferred method). The new continuous phase synthetic resin matrix can be, made with current commercial thermoplastic materials having low processing: costs and in addition have excellent toughness and reinforcement characteristics which help to increase finishing element life expectancy and thus further reduce costs to finish a semiconductor wafer. The new continuous phase synthetic resin matrix can be made with current commercial thermoplastic materials having broad range Shore A hardness, Shore D hardness, flexural modulus, Young's modulus, coefficient of friction, and resilience to customize the "responsiveness" of the finishing element finishing surface to applied pressure and the way it urges the fixed abrasives against the workpiece surface to effect finishing. Finishing element finishing surfaces having the new continuous phase synthetic resin matrix can be customized for localized polishing and/or global planarizing. The finishing element finishing surface having the new continuous phase synthetic resin matrix can be designed to enhance selectivity and improve control particularly near the endpoint. Still further, the new continuous phase synthetic resin matrix can be used as a reservoir to efficiently and effectively deliver finishing aids to the operative finishing interface. Finishing aids and/or preferred continuous phase synthetic resin matrices can help lubricate the operative finishing interface. Lubrication, preferable boundary lubrication, reduces breaking away of the abrasive particles from the surface of the fixed abrasive finishing element by reducing friction forces. Lubrication reduces the friction which reduces adverse forces particularly on a high speed belt fixed abrasive finishing element which under high friction can cause belt chatter, localized belt stretching, and/or belt distortions, high tendency to scratch and/or damage the workpiece surface being finished. Localized and/or micro localized distortions to the surface of a fixed abrasive finishing element and chatter can also occur with other finishing motions and I or elements and lubrication can reduce or eliminate these. By having synthetic resin particles having abrasives dispersed therein, the synthetic resin in the synthetic resin particles can be further customized by adjusting such preferred properties as Shore A hardness (Shore D hardness), flexural modulus, Young's modulus, coefficient of friction, and resilience to interact with both the workpiece surface being finished and also the continuous phase synthetic resin matrix to make a very versatile, low cost manufacturing platform to produce customized low cost fixed abrasive finishing elements. With the above advantages, the new fixed abrasive finishing elements can be customized and made on low cost, highly efficient manufacturing equipment to produce high performance, unique versatile fixed abrasive finishing elements. The finishing elements of this invention can improve the yield and lower the cost of finishing semiconductor wafer surfaces. Still further, preferred embodiments are described elsewhere herein.

A finishing surface comprising a multiphase polymeric mixture can suffer from delamination and/or separation at the interfaces of the polymeric phases. This delamination and/or separation can occur after finishing multiple workpiece surfaces due to the stresses applied to the multiphase polymeric mixture at the finishing surface. Examples of stresses applied during finishing are frictional forces and/or chemical forces. Finishing element surface conditioning discussed herein below can apply significant stresses to the finishing surface. Finishing element surface conditioning is generally repeated multiple times during the finishing element life. The regions of delamination and/or separation between the separate polymeric phases can trap wear particles from the workpiece surface and/or abrasive particles which have broken away from the abrasive finishing surface. These particles trapped in the operative finishing interface can cause unwanted surface scratches, unwanted microchatter, and/or unwanted surface damage. Connecting (preferably bonding) the discrete synthetic resin particles to a continuous phase of synthetic resin can reduce or eliminate delamination and/or separation which in turn can reduce unwanted surface defects to the workpiece surface being finished. This can also extend finishing element life which further reduces finishing costs. Use of compatibilizing polymers and/or reactive function groups to bond the discrete synthetic resin particles to the continuous phase of synthetic resin is preferred.

By having discrete synthetic resin particles with a low flexural modulus dispersed in a continuous phase of high flexural modulus material, a unique system for planarizing and polishing can be attained because the two different materials generally have different planarization lengths.

This new problem recognition and unique solution are new and considered part of this current invention.

Multiphase Synthetic Abrasive Finishing Element

Figure 4:
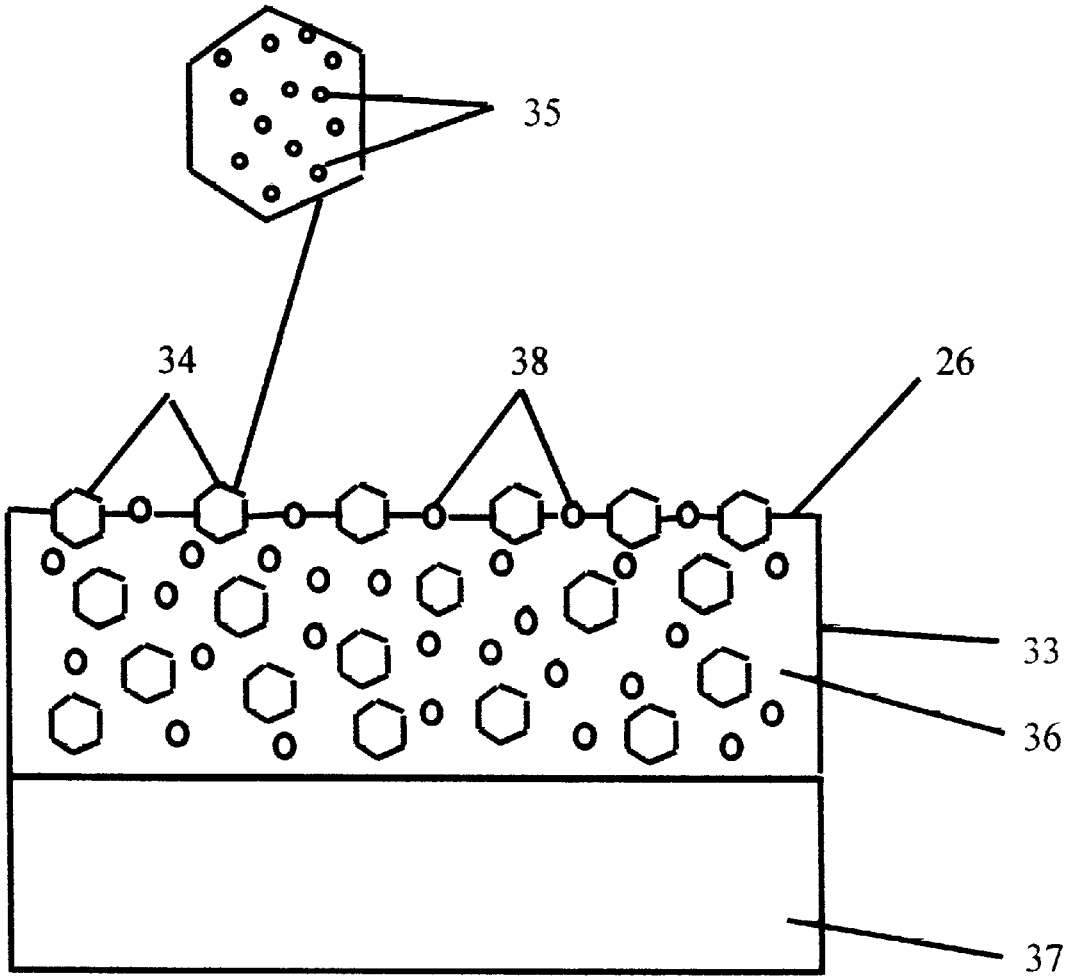
FIG. 4 is cross-sectional view of a fixed abrasive finishing element.

FIG. 4 represents an artist's cross-sectional view of a preferred embodiment of a multiphase finishing element according to this invention. Reference Numeral 33 represents the abrasive finishing element finishing surface layer. Reference Numeral 26 represents the finishing element finishing surface. Reference Numeral 34 represents the synthetic resin particles proximate to the finishing element finishing surface and dispersed in the continuous phase of synthetic resin matrix. Preferably the synthetic resin particles are dispersed in the continuous phase synthetic resin matrix. In one preferred embodiment, fixed abrasive particles are uniformly dispersed in the continuous phase synthetic resin matrix. In another preferred embodiment, abrasive particles can be dispersed in the continuous phase of synthetic resin. Abrasive particles can be dispersed in both the discrete synthetic resin particles and in the continuous phase of synthetic resin to advantage. Different abrasive particles dispersed in the continuous phase of synthetic resin and in the discrete synthetic resin particles is more preferred when abrasive particles are dispersed in both phases. By adjusting the type and location of the abrasive particles, the finishing element finishing characteristics can be adjusted to advantage for the workpiece being finished. Reference Numeral 35 represents the abrasive particles in a magnified view of the synthetic resin particles (Reference Numeral 34). Abrasive particles in either the continuous phase of synthetic resin or in discrete synthetic resin particles is particularly preferred. Reference Numeral 36 represents the continuous phase of synthetic resin matrix. Reference numeral 37 represents a finishing element subsurface layer. A finishing element subsurface layer free of finishing aids, more preferably free of lubricant, is particularly preferred. A finishing element subsurface layer free of lubricant is often a lower cost method, is easier to manufacture, and can also have higher reinforcement ability. Numeral 38 represents optional finishing aids dispersed in the continuous phase of synthetic resin matrix. A finishing element finishing surface layer having finishing aids dispersed in the continuous phase synthetic resin matrix is preferred and a finishing element finishing surface layer having finishing. aids uniformly dispersed in the continuous phase synthetic resin matrix is more preferred. A finishing aid uniformly dispersed in the continuous phase synthetic resin matrix is a preferred type of dispersion. A finishing aid having a plurality of discrete regions in the continuous phase synthetic resin matrix is a particularly preferred form of dispersion and a finishing aid having dispersed discrete, unconnected finishing aid particles therein is a more particularly preferred form of dispersion in the continuous phase of synthetic resin matrix.

The finishing element is preferably free of any plasticizers used solely to soften the finishing element and which can migrate in synthetic resin in the finishing element during finishing because this can reduce finishing stability. Nonmigrating polymeric plasticizers are preferred for softening of the continuous phase.

A finishing element comprising the synthetic resin polymer "A" and the synthetic resin polymer "B", each having a different glass transition temperature when measured by ASTM D3418 is preferred because this supports the existence of a two phase synthetic resin finishing element. A finishing element having a synthetic resin polymer "B" in the continuous phase having a glass transition temperature of less than a synthetic resin polymer "A" in the synthetic resin particles when measured by ASTM D3418 is also preferred because these finishing elements can uniquely have longer planarization length while applying a lower pressure to the individual abrasive particles which can reduce unwanted surface damage. A finishing element having a synthetic resin with a glass transition temperature of from −20 degrees to 120 degrees centigrade is preferred and from 0 degrees to 100 degrees centigrade is more preferred. Synthetic resins having a glass transition within these temperature ranges can help dampen unwanted vibrations in the finishing element during finishing and also help reduce some unwanted surface damage due to these vibrations. A synthetic resin having a glass transition from −20 degrees to 120 degrees is a preferred component in the finishing element sublayer. A crosslinked synthetic resin having a glass transition of from −20 to 120 degrees centigrade is more preferred because crosslinking can increase shear modulus and better resist plastic flow during finishing.

A finishing element surface layer and a finishing element subsurface layer comprising a multiphase synthetic organic polymeric composition is preferred.

Finishing Element Surface Layer

A finishing element finishing surface layer comprising a continuous phase of synthetic resin matrix having discrete synthetic resin particles is a preferred aspect of this invention. Discrete synthetic resin particles having a plurality of abrasive particles are another preferred aspect of this invention. Preferably the discrete synthetic resin particles are dispersed in the continuous phase synthetic resin matrix. More preferably the discrete synthetic resin particles are uniformly dispersed in the continuous phase synthetic resin matrix. Discrete synthetic resin particles which are connected to the continuous phase of synthetic resin matrix with a compatibilizing agent are preferred and synthetic resin particles which are bound to the continuous phase of synthetic resin matrix with a compatibilizing agent are more preferred. The synthetic resin composition in the synthetic resin particles is preferably different than the synthetic resin composition in the continuous phase synthetic resin. By having the synthetic resin particles dispersed in the continuous phase synthetic resin, the finishing element has a three dimensional aspect so that new abrasive surfaces can formed using finishing element conditioning discussed herein below. This extends finishing element life and reduces: costs. By having the synthetic resin particles connected to the continuous phase of synthetic resin matrix, the chance of these particles breaking away during finishing is reduced or eliminated. Synthetic resin particles which are bonded to the continuous phase synthetic resin matrix through covalent bonding are particularly preferred. Reactive functional groups on the synthetic resin particle surface and reactive functional groups on the synthetic resins of the continuous phase synthetic resin matrix can be preferred. A compatibilizing agent reactive functional which capable of reacting with some of the reactive functional groups on the synthetic resin particles and/or the continuous phase of synthetic resin is preferred for some finishing elements. Oxygen functional groups are illustrative nonlimiting preferred example of functional groups. A functional group having a reactive hydrogen is a preferred example of a reactive functional group. Illustrative examples of a functional group having a reactive hydrogen is a anhydride group, an alcoholic group, and carboxylic acid group. Some preferred nonlimiting oxygen functional groups are carboxylic acid, anhydride groups, epoxy groups, and alcohol groups. Free (broken away) synthetic resin particles during finishing have the potential to damage the semiconductor wafer surface during finishing.

The synthetic resin composition in the synthetic resin particles is preferably different than the synthetic resin composition in the continuous phase synthetic resin. By having a different synthetic resin composition in the synthetic resin particles as compared to the continuous phase synthetic resin composition, finishing aspects such as localized finishing and global finishing can be fine tuned. By having a different synthetic resin in the synthetic resin particles as compared to the continuous phase synthetic resin, finishing aspects such as polishing and planarizing can also be fine tuned. For instance a relatively stiff (higher flexural modulus) continuous phase synthetic resin can be used with synthetic resin particles made of a more flexible synthetic resin. This first customized finishing element would tend to have a more globalized finishing. In contrast, a relatively soft (lower flexural modulus) continuous phase can be used with a harder synthetic resin in the synthetic resin particles. This second customized finishing element would tend to have a higher localized finishing. In customizing the finishing element for specific applications, we currently believe that synthetic resin hardness (as measured in Shore D), flexural modulus, and resilience are preferred properties to adjust. A finishing element finishing surface layer having a synthetic resin with a Shore D hardness in the continuous phase which is different than the shore D hardness of the synthetic resin in the synthetic resin articles is preferred. A finishing element finishing surface layer having a synthetic resin with a flexural modulus in the continuous phase which is different than the flexural modulus of the synthetic resin in the synthetic resin particles is preferred. A finishing element finishing surface layer having a synthetic resin with a resilience in the continuous phase which is different than the resilience of the synthetic resin in the synthetic resin particles is preferred. These properties, their relationships, and adjustments thereto can aid those skilled in the art to develop custom finishing element surface layers.

A three dimensional abrasive finishing element surface layer as used herein is a abrasive finishing element surface layer having synthetic resin particles dispersed throughout at least a portion of its thickness, such that if some of the surface is removed additional synthetic resin particles are exposed on the newly exposed surface. A three dimensional finishing element surface layer is particularly preferred. A three dimensional fixed abrasive finishing element surface layer having a plurality of fixed abrasive synthetic resin particles substantially uniformly dispersed throughout at least a portion of its thickness is more preferred. A three dimensional fixed abrasive finishing element surface layer having a plurality of synthetic resin particles uniformly dispersed throughout at least a portion of its thickness is even more preferred. Having a three dimensional finishing element surface layer facilitates renewal of the finishing surface during finishing element conditioning. A three dimensional fixed abrasive finishing element having a majority of the synthetic resin particles fully surrounded by the continuous phase of synthetic resin is preferred and a three dimensional fixed abrasive finishing element having at least 75% of the synthetic resin particles fully surrounded by the continuous phase of synthetic resin is more preferred and a three dimensional fixed abrasive finishing element having at least 90% of the synthetic resin particles fully surrounded by the continuous phase of synthetic resin is even more preferred. At most 100% of the synthetic resin particles surrounded by the continuous phase of synthetic resin is preferred and at most 99.9% the synthetic resin particles surrounded by the continuous phase of synthetic resin is more preferred. A three dimensional fixed abrasive finishing element having from 50% to 100% of the synthetic resin particles fully surrounded by the continuous phase of synthetic resin is preferred and a three dimensional fixed abrasive finishing element having from 75% to 100% of the synthetic resin particles fully surrounded by the continuous phase of synthetic resin is more preferred and a three dimensional fixed abrasive finishing element having from 75% to 99.9% of the synthetic resin particles fully surrounded by the continuous phase of synthetic resin is even more preferred. By having a majority of the synthetic resin particles fully surrounded by the continuous phase of synthetic resin, as the finishing element finishing surface is worn or conditioned new synthetic resin particles will be exposed to maintain the more uniform finishing with time and over a number of semiconductor wafers.

A fixed abrasive finishing element surface layer having a finishing surface which applies a substantially uniform distribution of abrasive particles over the workpiece surface being finished is preferred and a fixed abrasive finishing element surface layer which applies a uniform distribution of abrasive particles over the workpiece surface being finished is more preferred. This improves finishing uniformity of the semiconductor surface during finishing.

A finishing element which is thin is preferred because it generally transfers the operative finishing motion to the workpiece surface being finished more efficiently. A finishing element having a thickness from 0.5 to 0.002 cm is preferred and a thickness from 0.3 to 0.005 cm is more preferred and a finishing element having a thickness from 0.2 to 0.01 cm is even more preferred. Current synthetic resin materials can be made quite thin now. The minimum thickness will be determined by the finishing element's integrity and longevity during polishing which will depend on such parameters as tensile and tear strength. A finishing element having sufficient strength and tear strength for chemical mechanical finishing is preferred. A fixed abrasive finishing element comprising at least one layer of a elastomeric synthetic polymer is preferred. A fixed abrasive finishing element comprising at least one layer of a thermoset elastomeric synthetic polymer is preferred.

A finishing element surface having a continuous phase of synthetic resin and synthetic resin particles having similar wear rates during finishing when measured in nanometers of wear per minute is preferred. By having the wear rate be similar, the abrasive particles can apply a more uniform finishing rate over time on the workpiece surface being finished both within a particular workpiece finishing operation and from workpiece to workpiece. Discrete synthetic resin particles having a wear rate during finishing which is from 50% to 150% of the wear rate of a continuous phase of synthetic resin matrix when measured in nanometers per minute is preferred and discrete synthetic resin particles having a wear rate during finishing which is from 70% to 133% of the wear rate of a continuous phase of synthetic resin matrix when measured in nanometers per minute is more preferred and discrete synthetic resin particles having a wear rate during finishing which is from 80% to 120% of the wear rate of a continuous phase of synthetic resin matrix when measured in nanometers per minute is even more preferred. A wear control agent in the discrete synthetic resin particles is preferred. A wear control agent in the continuous phase of synthetic resin is also preferred. A wear control agent in both the discrete synthetic resin particles and in the continuous phase of synthetic resin is particularly preferred. A wear reducing agent is a particularly preferred type of wear control agent. Fibers are an example of a preferred wear control agent. Dispersed lubricants are another example of a preferred wear control agent. Dispersed particles having an aspect ratio of at most 3/1 and modifying wear is another preferred example of wear control agent. Incorporation of wear control agents such as fibers, lubricants, and dispersed particles are discussed further elsewhere herein.

By having discrete synthetic resin particles with a low flexural modulus dispersed in a continuous phase of high flexural modulus material, a unique system for planarizing and polishing can be attained because the two different materials generally have different planarization lengths. Planarization lengths can be determined through a convolution and discrete filter design technique, through regression analysis, and by direct measurement if special masks are used to generate step density topography. Further details are found in "Wafer-Scale Modeling of pattern effect in oxide chemical mechanical polishing" by D. Ouma, B. Stine, R. Divecha, D. Boning, J. Chung, G. Shinn, I. Ali, and J. Clark in SPIE Microelectronics Manufacturing Conference, Microelectronic Device Session, Austin, Tex., October 1997 and both references are included in are included in their entirety by reference for guidance. Discrete synthetic resin particles with an inherent planarization length of less than the continuous phase of synthetic resin are currently preferred for some semiconductor wafer finishing to add a new degree of control to finishing element customization.

Figure 5:
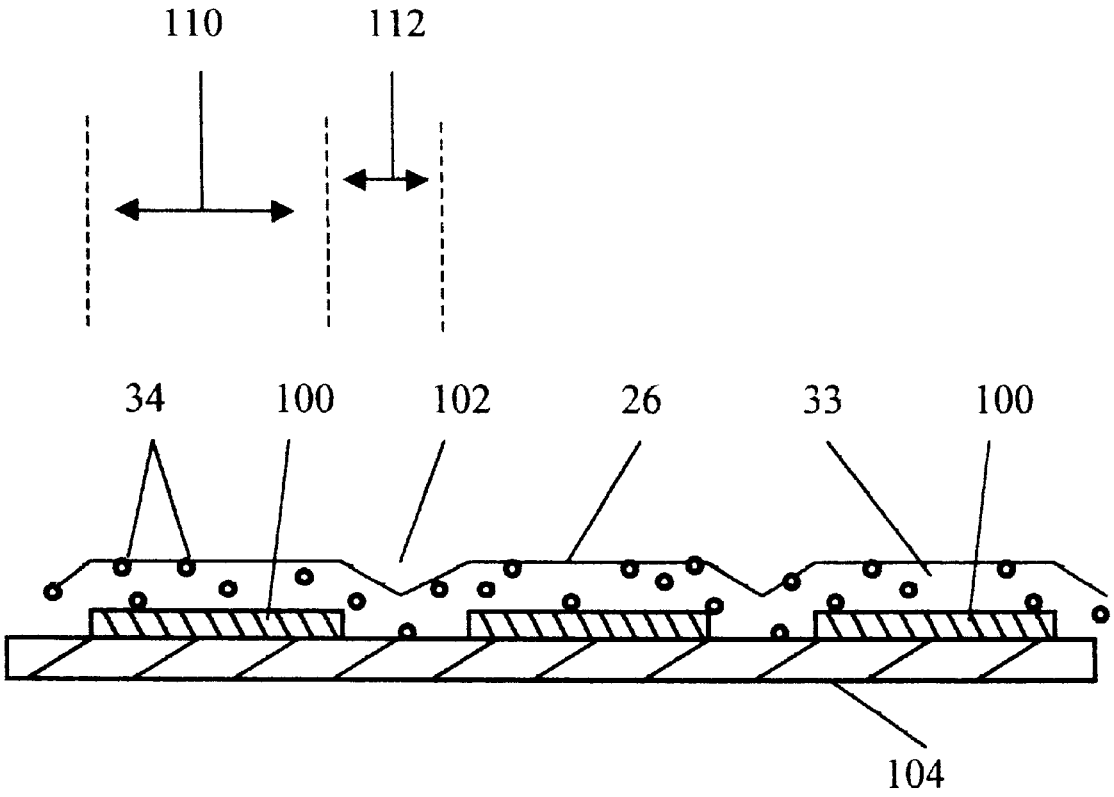
FIG. 5 is cross-sectional view of a finishing element having discrete stiffening members.

A finishing element finishing surface having a substantially flat finishing surface is preferred and a finishing element finishing surface having a flat finishing surface is more preferred particularly when discrete stiffening members are used with feed channels there between as shown in FIG. 5 below. The finishing element finishing surface having a three dimensional topography to enhance finishing composition supply to the workpiece surface is preferred for some applications. Some applicable three dimensional topographies are described in patents included: herein by reference.

Finishing Element Surface Layer—Continuous Phase Synthetic Resin Matrix

A fixed abrasive finishing element surface layer having a continuous phase synthetic resin matrix is preferred. This continuous phase synthetic resin matrix forms a binding resin which encapsulates many or all of the synthetic resin particles which in turn have the abrasive particles therein. A continuous phase synthetic resin matrix comprising at least one material selected from the group consisting of an organic synthetic polymer, an inorganic polymer, and combinations thereof is preferred. A preferred example of organic synthetic resin polymer is a thermoplastic polymer. Another preferred example of an organic synthetic resin polymer is a thermoset polymer. An organic synthetic polymeric body with a continuous phase comprising organic synthetic polymers including materials selected from the group consisting of polyurethanes, polyolefins, polyesters, polyamides, polystyrenes, polycarbonates, polyvinyl chlorides, polyimides, epoxies, chloroprene rubbers, ethylene propylene elastomers, butyl polymers, polybutadienes, polyisoprenes, EPDM elastomers, and styrene butadiene elastomers is preferred. Acrylic polymers, styrene block copolymers and cyclic olefin copolymers are preferred. Acetal and ethylene carbon monoxide polymers are also preferred. Thermoplastic elastomers can be a preferred type of continuous phase synthetic resin matrix. Block copolymers are preferred because the physical and chemical performance can be adjusted for the particular workpiece finishing task. Styrene block copolymers are particularly preferred for their broad performance characteristics. A polymer containing styrene is a preferred polymer. Thermoplastic block copolymers have excellent elastomeric properties such as resistance to flexural fatigue. Polyolefin polymers are particularly preferred for their generally low cost. A preferred polyolefin polymer is polyethylene having broad, cost effective performance characteristics. Ethylene copolymers are a preferred polyolefin polymer. Polymers made by singe site catalysts are preferred polymers. Metallocene copolymers are preferred polymers. They can have high purity with less residue along with carefully customized physical properties for plastics, elastomers, and plastomers. Dow and Exxon manufacture nonlimiting preferred examples of single site catalyzed and metallocene catalyzed polyolefins. Another preferred polyolefin polymer is a propylene polymer. High density polyethylene and ultra high molecular weight polyethylene are preferred ingredients in the continuous phase synthetic resin matrix because they are low cost, thermoplastically processible and have a low coefficient of friction. A cross-linked polyolefin, even more preferably cross-linked polyethylene, can be a especially preferred continuous phase synthetic resin matrix. Another preferred polyolefin polymer is an ethylene propylene copolymer. A fluorocarbon polymer can also form an effective continuous phase with excellent chemical stability. Copolymer organic synthetic polymers are also preferred. Polyurethanes are preferred for their inherent flexibility in formulations. A continuous phase synthetic resin matrix comprising a foamed synthetic resin matrix is particularly preferred because of its flexibility and ability to transport the finishing composition. A finishing element comprising a foamed polyurethane polymer is particularly preferred. A foamed polyurethane: has desirable abrasion resistance combined with good costs. Foaming agents and processes to foam organic synthetic polymers. are generally known in the art. A cross-linked continuous phase synthetic resin matrix is preferred for its generally enhanced thermal resistance. A cross-linked polymer can be crosslinked enough to improve physical properties while maintaining some thermoplastic processing character. Alternately, when enhanced thermal resistance is require or resistance to swelling is required, increased crosslinking is preferred. A finishing element comprising a compressible porous material is preferred and one comprising an organic synthetic polymer of a compressible porous material is more preferred. Preferred synthetic resins include epoxy organic synthetic resins, polyurethane synthetic resins, and phenolic synthetic resins. Organic synthetic resins selected from the group consisting of polysulfone, polyphenylene sulfide, and polyphenylene oxide are also preferred. A syndiotactic polystyrene is a preferred continuous phase synthetic resin. They have a good balance of stiffness and resistance to acids, bases, and/or both acids and bases. Organic synthetic resins which can be reaction injection molded are preferred resins. An example of a reaction injection moldable organic synthetic resin is polyurethane. Copolymer organic synthetic polymers are also preferred. Organic synthetic resins having reactive function group(s) can be preferred for some composite structures because they can improve bonding between different materials and/or members. Some preferred reactive functional groups include reactive functional groups containing oxygen and reactive functional groups containing nitrogen. Organic synthetic resins having polar functional groups can also be preferred.

A continuous phase synthetic resin matrix comprised of a mixture of a plurality of organic synthetic resins can be particularly tough, wear resistant, and useful. A continuous phase organic synthetic resin matrix comprising a plurality of organic synthetic polymers and wherein the major component is selected from materials selected from the group consisting of polyurethanes, polyolefins, polyesters, polyamides, polystyrenes, polycarbonates, polyvinyl chlorides, polyimides, epoxies, chloroprene rubbers, ethylene propylene elastomers, butyl polymers, polybutadienes, polyisoprenes, EPDM elastomers, and styrene butadiene elastomers is preferred. The minor component is preferably also an organic synthetic resin and is preferably a modifying and I or toughening agent. A modifying agent having a reactive functional group capable of reacting with the continuous phase synthetic resin can be preferred. A modifying agent having reactive functional groups capable of covalently bonding with the continuous phase of synthetic resin is more preferred. A reactive polymer modifier is a preferred example of a modifying agent. A preferred example of an organic synthetic polymer modifier is a material which reduces the hardness or flex modulus of the finishing element such an polymeric elastomer. A compatibilizing agent can also be used to:improve the physical properties of the polymeric mixture. Compatibilizing agents are often also synthetic polymers and have polar and/or reactive functional groups such as hydroxyl groups, carboxylic acid, maleic anhydride, and epoxy groups.

An abrasive finishing element having a continuous phase synthetic resin matrix having flex modulus in particular ranges is also: preferred. A finishing element having a continuous phase synthetic resin matrix having a high flex modulus is generally more efficient for planarizing. A finishing element having a continuous phase synthetic resin matrix having a low flex modulus is generally more efficient for polishing. Further a continuous belt fixed abrasive finishing element can have a different optimum flex modulus than a fixed abrasive finishing element disk. One also needs to consider the workpiece surface to be finished in selecting the flex modulus. An abrasive finishing element, more preferably a fixed abrasive finishing element, having a continuous phase synthetic resin matrix having flex modulus of at most 1,000,000 psi is preferred and having a flex modulus of at most 800,000 psi is more preferred and 500,000 psi is more preferred. Pounds per square is psi. Flex modulus is preferably measured with ASTM 790 B at 73 degrees Fahrenheit. A fixed abrasive finishing element having a continuous phase synthetic resin matrix having a very low flex modulus is also generally known to those skilled in the art (such as elastomeric polyurethanes which can also be used). A fixed abrasive finishing element having a continuous phase synthetic resin matrix having a flex modulus of greater than 1,000,000 psi can be preferred for some particular planarizing applications.

A fixed abrasive finishing element having a continuous phase synthetic resin matrix having Young's modulus in particular ranges is also preferred. A fixed abrasive finishing element having a continuous phase synthetic resin matrix having a high Young's modulus is generally more efficient for planarizing. A fixed abrasive finishing element having a continuous phase synthetic resin matrix and having a low Young's modulus is generally more efficient for polishing. Further a continuous belt fixed abrasive finishing element can have a different optimum Young's modulus than a fixed abrasive finishing element disk. One also needs to consider the workpiece surface to be finished in selecting the Young's modulus. For a flexible fixed abrasive finishing element having a continuous phase synthetic resin matrix having a Young's modulus from 100 to 700,000 psi (pounds per square in inch) is preferred and having a Young's modulus from 300 to 200,000 psi (pounds per square in inch) is more preferred and having a Young's modulus from 300 to 150,000 psi (pounds per square in inch) is even more preferred. A fixed abrasive finishing element having a continuous phase synthetic resin matrix with a Young's modulus of at least 700,000 psi can be preferred for some applications needing extra care for global planarization. For particularly flexible applications, a fixed abrasive finishing element having a continuous phase synthetic resin having a Young's modulus of less than 200,000 psi are preferred and less than 100,000 psi are more preferred and less than 50,000 psi are even more preferred. A fixed abrasive finishing element having a continuous phase synthetic resin having a Shore A hardness of at least 30 A is preferred for some applications. ASTM D 676 is used to measure hardness. A porous finishing element is preferred to more effectively transfer the polishing slurry to the surface of the workpiece being finished.

An optional stabilizing filler dispersed in the continuous phase of the finishing element surface layer can help improve wear resistance of the finishing element. A preferred stabilizing filler is a fibrous filler.

Young's Modulus for non-resilient materials can be measured by standard techniques. As used herein, resilience is related to the elastic rebound and stiffness in compression and also to the thickness of the material. Young's modulus of an organic polymer is measured by ASTM D638-84. For thin films, ASTM D882-88 can be used.

Young's Modulus for resilient materials can also be measured by standard techniques. Dynamic compressive testing can be used to measure Young's Modulus in the thickness direction. For resilient materials, ASTM D5024-94 is used. The resiliency testing is carried out at 0.1 Hz at 20 degrees centigrade with a preload of 34.5 kPa.

A high flexural modulus organic synthetic resin comprising an engineering polymer is also preferred. A high flexural modulus organic synthetic resin containing even higher modulus organic synthetic resin particles can also be preferred . An illustrative example of the manufacture of a tough high flexural modulus synthetic resin containing an even higher modulus organic synthetic resin particles is found in U.S. Pat. No. 5,508,338 to Cottis et al. As used herein, even higher flexural modulus organic synthetic resin particles than the continuous region of high flexural modulus organic synthetic resin can be abrasive particles. Synthetic resin particles which abrade a low-k dielectric, layer are preferred and abrasive synthetic resin particles dispersed in larger synthetic resin particles such as those shown in Reference Numeral 35 in FIG. 4 are more preferred. A discrete finishing member having discrete abrasive organic synthetic resin particles is preferred for some low-k dielectric layer finishing. Abrasive organic synthetic resin particles having a flexural modulus of at most 100 times higher than the low-k dielectric layer flexural modulus is preferred and having a flexural modulus of at most 50 times higher than the low-k dielectric layer flexural modulus is more preferred and having a flexural modulus of at most 25 times higher than the low-k dielectric layer flexural modulus is even more preferred. Abrasive organic synthetic resin particles having a flexural modulus of at least equal to the low-k dielectric layer flexural modulus is preferred and having a flexural modulus of at least 2 times higher than the low-k dielectric layer flexural modulus is more preferred. Flexural modulus is believed to be useful for guidance to aid initial screenings. Abrasive synthetic resin particles can help to reduce unwanted surface damage of the low-dielectric layer.

For finishing of semiconductor wafers having low-k dielectric layers, finishing aids, more preferably lubricating aids, are preferred. Illustrative nonlimiting examples of low-k dielectrics are low-k polymeric materials, low-k porous materials, and low-k foam materials. As used herein, a low-k dielectric has at most a k range of less than 3.5 and more preferably less than 3.0. Illustrative examples include doped oxides, organic polymers, highly fluorinated organic polymers, and porous materials. Low-k dielectric materials are generally known to those skilled in the semiconductor wafer arts.

Finishing Element Surface Layer—Synthetic Resin Particles

A synthetic resin particle having abrasive particles therein is particularly preferred in this invention. This synthetic resin in the synthetic resin particles forms a binding resin which fixes the abrasive particles therein. An organic synthetic resin is preferred. A preferred example of organic synthetic resin is a thermoplastic resin. Another preferred example of an organic synthetic polymer is a thermoset resin. Another example of a preferred synthetic resin for synthetic resin particles is a synthetic resin which can be dynamically vulcanized. A thermoset synthetic resin is less prone to elastic flow and thus can be more stable in this application. A thermoset polyurethane resin is currently particularly preferred for the synthetic resin particles. The hardness, softness, resilience, and abrasion resistance can be adjusted by chemistry generally known to those skilled in the art. Further, different methods to bind the abrasive particles to the synthetic resin matrix are generally known to those skilled in the art. Abrasive particles that are covalently bonded to synthetic resin in the synthetic resin particles are particularly preferred. As used herein, covalently bonded to the synthetic resin means that the abrasive particles are either bonded covalently directly to the synthetic resin or bonded covalently through at least one additional molecule to the synthetic resin. A synthetic resin of the synthetic resin particles selected from the group consisting of polyurethanes, polyolefins, polyesters, polyamides, polystyrenes, polycarbonates, polyvinyl chlorides, polyimides, epoxies, chloroprene rubbers, ethylene propylene elastomers, butyl polymers, polybutadienes, polyisoprenes, EPDM elastomers, and styrene butadiene elastomers is preferred. Polyolefin polymers are particularly preferred for their generally low cost. A preferred polyolefin polymer is polyethylene. Another preferred polyolefin polymer is a propylene polymer. Acrylic polymers, styrene block copolymers, cyclic olefin copolymers are also preferred. Ethylene carbon monoxide and acetal polymers can be preferred polymers. Thermoplastic elastomers can be a preferred type of continuous phase of synthetic resin. Block copolymers are preferred because the physical and chemical performance can be adjusted for the particular workpiece finishing task. Styrene block copolymers are particularly preferred for their broad performance characteristics. Thermoplastic block copolymers have excellent elastomeric properties such as resistance to flexural fatigue. A polymer having styrene monomers is preferred because the broad availability of physical properties. Polyolefin polymers are particularly preferred for their generally low cost. A preferred polyolefin polymer is polyethylene having broad, cost effective performance characteristics. Ethylene copolymers are a preferred polyolefin polymer. Polymers made by singe site catalysts are preferred polymers. Metallocene copolymers are preferred polymers. They can have high purity with less residue along with carefully customized physical properties for plastics, elastomers, and plastomers. Dow and Exxon manufacture nonlimiting preferred examples of single site catalyzed and metallocene catalyzed polyolefins. A preferred polyolefin polymer is polyethylene having broad, cost effective performance characteristics. Softness can be adjusted with type and comonomer loading. Metallocene polyolefins are preferred because they can be customized to individual needs and can generally achieve very high purity polymers with low contamination. A preferred example of a thermoplastic elastomer is a polyolefin elastomer (POE). An example of a polyolefin elastomer is ENGAGE® manufactured and sold by Dow Chemical Company. Illustrative examples of ENGAGE® are EG 8100. ENGAGE® POEs are ethylene alpha olefin copolymers. Some typical properties as published by Dow Chemical for EG 8100 are density by ASTM D-792 of 0.87 g/cc, percent comonomer (octene) ASTM D-1238 of 24%, Shore A hardness by ASTM D-2240 of 75, and a brittleness temperature of less than −76 degrees centigrade. Ethylene propylene elastomers are also effective. "Affinity" and "Engage" by Dow chemical are nonlimiting examples of metallocene polyolefins. Elastomers are particularly preferred. High density polyethylene and ultra high molecular weight polyethylene are preferred ingredients in the continuous phase synthetic resin matrix because they are low cost, thermoplastically processible and have a low coefficient of friction. Another preferred polyolefin polymer is a ethylene propylene copolymer. Copolymer organic synthetic polymers are also preferred. Polyurethanes are preferred for the inherent flexibility in formulations. A synthetic resin in the synthetic resin particle comprising a foamed synthetic resin matrix is can be preferred for some final finishing because of its flexibility and general resilience. A foamed polyurethane polymer is particularly preferred. A foamed polyurethane has desirable abrasion resistance combined with good costs. Foaming agents and processes to foam organic. synthetic polymers are generally known in the art. A finishing element comprising a compressible porous material is preferred and one comprising a organic synthetic resin of a compressible porous material is more preferred. A cross-linked synthetic resin particle is preferred.

A synthetic resin in the synthetic resin particle having a Shore A hardness of at least 30 A is preferred. A soft synthetic resin is particularly useful for localized finishing. ASTM D 676 is used to measure Shore A hardness. A porous finishing element is preferred to more effectively transfer the polishing slurry to the surface of the workpiece being finished.

The low modulus synthetic resin is preferably dispersed in discrete regions. A preferred minor component is a soft synthetic resin and more preferably a soft organic synthetic resin. Synthetic resin particles forming discrete regions having a maximum dimension of at most 5 microns are preferred and a maximum dimension of at most 1 micron is more preferred and a maximum dimension of at most 0.5 micron is even more preferred. Synthetic resin particles forming discrete regions having a minimum dimension of at least 0.005 microns is preferred and more preferably a minimum dimension of at least 0.01 micron is more preferred and a minimum dimension of at most 0.015 micron is even more preferred. The minor component is dispersed in discrete regions, preferably soft organic synthetic resin particles, having a maximum dimension of from 5 to 0.01 microns is preferred and more preferably a maximum dimension of from 1 to 0.015 microns. Soft synthetic resin particles which are free of voids are preferred. Small synthetic resin particles can toughen the continuous phase of synthetic resin and improve finishing versatility.

Synthetic resin particles having abrasive particles dispersed therein can be made by generally known procedures to those skilled in the abrasive arts. For example, an abrasive slurry can be formed by mixing thoroughly 10 parts of trimethanolpropane triacrylate, 30 parts of hexanediol diacrylate, 60 of parts alkl benzyl phthalate plasticizer, 6.6 parts of isopropyl triisostearoly titanate, 93.2 parts of 2,4, 6-trimethylbenzoyl-diphenyl-phosphine oxide photoiniatator and then mixing in 170 parts of cerium oxide followed by mixing in a further 90 parts of calcium carbonate and then curing in a thin sheets. The cured sheets are then ground into synthetic resin particles having abrasive particles therein. As a second and currently preferred example, to a monomer phase of a synthetic resin having a reactive functional group(s)is added a second linking monomer which in turn has a both a linking functional group and a particulate bonding group. The linking functional group is selected to covalently bond to the synthetic resin reactive functional group. The abrasive particle bonding group is selected to covalently bond with the abrasive particles such as silica. An example of a lining monomer is alkyl group with from 8–20 carbon atoms and having a carboxylic linking functional group and a trichlorosilane abrasive particle bonding group. Additional preferred, non limiting examples of useful bonding groups include carboxylic acid groups, epoxy groups, and anhydride groups. Additional nonlimiting information on the formation of synthetic resin matrices having abrasive particles dispersed and/or bound therein include U.S. Pat. No. 5,624,303 to Robinson, U.S. Pat. No. 5,692,950 to Rutherford et. al., and U.S. Pat. No. 5,823,855 to Robinson et al. and are included herein by reference in their entirety for guidance and modification as appropriate by those skilled in the art. Synthetic matrices having dispersed abrasive particles can be formed into synthetic resin particles having dispersed abrasive particles by using grinding technology generally known to those skilled in the art. Cold grinding is sometimes helpful. Cryogenic grinding can also be useful. Methods to sort by size are generally known and preferable. Further, the synthetic resin particles are preferably cleaned before use. Washing using generally known solvents and/or reagents can also be useful.

The abrasive particles can be melt mixed with synthetic resin used in the discrete synthetic resin particles and then this mixed composition can be melt mixed with the continuous phase of synthetic resin. Mixing with melt shearing is preferred. High shear melt mixing equipment is more preferred. Alternately, the abrasive particles, the synthetic resin in the synthetic resin particles, and the continuous phase of synthetic resin can be mixed. Mixing the abrasive particles, the synthetic resin in the synthetic particles, and synthetic resin in the continuous phase in one pass through a melt mixing device is preferred and in a high shear melt mixing device is more preferred. A twin screw extruder is a nonlimiting example of a preferred high shear melt mixing device. The finishing element can then be injection molded or extruded. Calendering of the extruded article to improve surface thickness is preferred. Further mixing and molding guidance is given elsewhere herein.

The inorganic abrasive particles can be used without treatment. The inorganic abrasive particles can be treated with an inorganic surface-treating agent, i.e., a higher aliphatic acid or a derivative thereof such as an ester or salt thereof (e.g. stearic acid, oleic acid, palmitic acid, calcium stearate, magnesium stearate, aluminum stearate, stearic acid amide, ethyl stearate, methyl stearate, calcium oleate, oleic acid amide, ethyl oleate, calcium palmirate, palmitic acid amide and ethyl palmirate); and a coupling agent (e.g. vinyl trimethoxysilane, vinyl triethoxysilane, vinyl triacetoxysilane, and other known silane containing coupling agents). A polysiloxane and derivative thereof can be an effective coupling agent. An aminosilane and derivatives thereof can be an effective coupling agent. A non-limiting example includes U.S. Pat. No. 5,849,052 to Barber, Jr. and is included in its entirety by reference for general guidance and modification by those skilled in the arts. A coupling agent can provide a bridge between the synthetic resin and the abrasive particles. Some nonlimiting preferred examples of coupling agents include silanes, titanates, and zircoaluminates.

Soft discrete organic synthetic resin particles having an aspect ratio of from 1/4 to 1/1 are preferred and from 2/1 to 1/1 are more preferred. Substantially spherical synthetic resin particle can be preferred for some applications. Spherical synthetic resin particles formed dynamically during melt mixing are particularly preferred. Synthetic resin particles having rough or sharp edges are not as preferred because they can have a higher tendency to cause unwanted surface damage during finishing. Synthetic resin particles having relatively high aspect ratios can be more easily broken away from the finishing surface which can lead to unwanted surface damage to the semiconductor wafer. Spherical synthetic resin particles can reduce the tendency to damage the workpiece during finishing. Addition of a secondary component comprising a soft synthetic resin which reduces the flexural modulus of the high flexural modulus organic synthetic resin by 10% is preferred and addition of a secondary component comprising a soft synthetic resin which reduces the flexural modulus of the high flexural modulus organic synthetic resin by 20% is more preferred and addition of a secondary component comprising a soft synthetic resin which reduces the flexural modulus of the high flexural modulus organic synthetic resin by 25% is even more preferred. Addition of a secondary component comprising a synthetic resin which reduces the flexural modulus of the high flexural modulus organic synthetic resin from 5% to 90% is preferred and addition of a secondary component comprising a synthetic resin which reduces the flexural modulus of the high flexural modulus organic synthetic resin from 10% to 60% is more preferred and addition of a secondary component comprising a synthetic resin which reduces the flexural modulus of the high flexural modulus organic synthetic resin from 15% to 50% is even more preferred. Addition of an organic synthetic polymer modifier, preferably a soft organic synthetic resin, to a high flexural modulus organic synthetic resin in an amount that the high flexural modulus material comprises from 30% to 97% by weight of the total organic synthetic resin is preferred and addition of an organic synthetic polymer modifier to a high flexural modulus organic synthetic resin in an amount that the high flexural modulus material comprises from 40% to 90% by weight of the total organic synthetic resin is more preferred. Addition of an organic synthetic polymer modifier, preferably a soft organic synthetic resin, to a continuous phase of synthetic resin in an amount that the continuous phase comprises from 30% to 97% by weight of the total organic synthetic resin is preferred and addition of an organic synthetic polymer modifier to a continuous phase of synthetic resin in an amount so that the continuous phase material comprises from 40% to 90% by weight of the total organic synthetic resin is more preferred. By mixing a minor component, more preferably an organic synthetic polymer modifier, even more preferably an a soft synthetic resin, with a high flexural modulus organic synthetic resin, preferably a stiff organic synthetic resin, the multiphase synthetic resin mixture can be made tougher, less prone to cracking, and less prone to cause unwanted surface damage to the workpiece surface being finished. Further, one can mix the abrasive particles in with the soft synthetic resin and then mix the soft synthetic resin having abrasive particles dispersed therein into the high flexural modulus organic synthetic resin, preferably a stiff organic synthetic resin. A high flexural modulus organic synthetic resin, preferably a stiff organic synthetic resin, which is substantially free of abrasive particles is preferred and a high flexural modulus organic synthetic resin, preferably a stiff organic synthetic resin, which is free of abrasive particles is more preferred. Thus in this preferred embodiment, one proceeds opposite what one of ordinary skill in the art might do to manufacture a stiff discrete finishing member. One does not select solely a stiff organic synthetic resin, one selects an organic synthetic resin with a flexural modulus higher than desired and then modifies it to produce a tougher discrete finishing member less prone to failure during manufacture, shipping, handling, and finishing. Flexural modulus is measured with ASTM 790 B at 73 degrees Fahrenheit to determine the percentage change in the flexural modulus. Use of ASTM 790 B is generally known to those skilled in the polymer arts. All referenced ASTM test methods such as ASTM 790 B are included herein in their entirety by reference for general guidance.

A preferred example of an organic synthetic polymer modifier is a material which reduces the hardness or flexural modulus of the finishing element body such an polymeric elastomer. A compatibilizing agent can also be used to improve the physical properties of the polymeric mixture. Compatibilizing agents are often also synthetic polymers and have polar and/or reactive functional groups such as hydroxyl groups, carboxylic acid, maleic anhydride, and epoxy groups. Compatibilizing agents having a chemically reactive functional group are preferred. Compatibilizing agents having a chemically reactive functional group containing oxygen are preferred for many polymer compositions. Compatibilizing agents having a chemically reactive functional group containing nitrogen are preferred for many polymer compositions. An amine functional group is an example of a preferred reactive functional group containing nitrogen. The commercial suppliers of compatibilizing agents can generally recommend preferred compatibilizing agents for particular polymeric compositions. A compatibilizing agent which increases the dispersion of the soft synthetic resin in the stiff organic synthetic resin is preferred. A compatibilizing agent can improve the toughness of the resin. One measure of toughness is by the Notched Izod Impact test at 23 degrees centigrade (ASTM D256). Another indicator of toughness is Fatigue Endurance as measured by ASTM D671.

Interface Between the Discrete Synthetic Resin Particles and Continuous Phase of Synthetic Resin Fixedly attaching the discrete synthetic resin particles to the continuous phase of synthetic resin is a preferred method of connecting the two phases. Bonding is a preferred means of fixed attachment. A discrete synthetic resin particle which is fixedly attached to the continuous phase of synthetic resin and which, when it is physically separated from the continuous phase, results in cohesive failure, is preferred. A discrete synthetic resin particle which is fixedly attached to the continuous phase of synthetic resin and which, when physically separated, results in a separation which is free of adhesive failure, is particularly preferred. Preferred means for fixedly attaching the discrete synthetic resin particle to the continuous phase of synthetic resin include the formation of chemical bonds and more preferably covalent chemical bonds. Another preferred means for fixedly attaching the discrete synthetic resin particle to the continuous phase of synthetic resin includes the polymer chain interdiffusion. A combination of polymer chain interdiffusion bonding and covalent chemical bonds is particularly preferred.

A compatibilizing agent can be used to bond the discrete synthetic resin particle to the continuous phase of synthetic resin. A compatibilizing polymer is a preferred compatibilizing agent. A compatibilizing polymer wherein the polymer which includes chemically distinct sections some of which are miscible with one component and some of which are miscible with a second component in a multiphase polymer mixture is preferred. A compatibilizing polymer "C" which includes chemically distinct sections some of which are miscible with one polymer "A" and some of which are reactive with a second polymer "B" in a multiphase polymer mixture is more preferred. A compatibilizing polymer which chemically reacts with at least one of the immiscible polymers "A" or "B" can be preferred. Diblock copolymers and graft copolymers are examples of preferred types of polymeric compatibilizers. Compatibilizing polymers comprising synthetic polymers and having polar and/or reactive functional groups such as hydroxyl groups, carboxylic acid, maleic anhydride, and epoxy groups are preferred. A compatibilizing polymer having a section which have a higher molecular weight than the molecular weight of the immiscible polymers can be preferred. A graft copolymer is a particularly preferred compatibilizing polymer because they can be made by techniques generally known in the polymer arts at high volume, low cost having electronic purity and many different reactive and/or miscible ends. A polymeric compatibilizing agent having a chemically reactive oxygen functional group is preferred for many polymeric systems. Hydroxyl groups, epoxy groups, carboxylic acid groups and anhydride groups are examples of preferred chemically reactive oxygen functional groups. A polymeric compatibilizing agent having a chemically reactive nitrogen functional group is preferred for many polymeric systems.

A finishing element surface having discrete synthetic resin particles fixedly attached to the continuous phase of synthetic resin for finishing at least 50 workpiece surface is preferred and for finishing at least 100 workpiece surfaces is more preferred and for finishing at least 300 workpiece surfaces is even more preferred. The maximum number of workpiece surfaces which can be using this technology is expected to be very large. By finishing more workpieces with the same finishing element surface having discrete synthetic resin particles fixedly attached to the continuous phase of synthetic resin for finishing the cost to manufacture semiconductor wafers is reduced and the unwanted surface damage can be reduced.

Finishing Element Surface Layer—Abrasive Particles

Illustrative nonlimiting examples of abrasive particles in the synthetic resin particles comprise silica, silicon nitride, alumina, and ceria. Fumed silica is particularly preferred. A metal oxide is a type of preferred abrasive particle. A particularly preferred particulate abrasive is an abrasive selected from the group consisting of iron (III) oxide, iron (II) oxide, magnesium oxide, barium carbonate, calcium carbonate, manganese dioxide, silicon dioxide, cerium dioxide, cerium oxide, chromium (III) trioxide, and aluminum trioxide. Abrasive particles having an average diameter of less than 0.5 micrometers are preferred and less than 0.3 micrometer are more preferred and less than 0.1 micrometer are even more preferred and less than 0.05 micrometers are even more particularly preferred. Abrasive particles having an average diameter of from 0.5 to 0.01 micrometer are preferred and between 0.3 to 0.01 micrometer are more preferred and between 0.1 to 0.01 micrometer are even more preferred. These abrasive particles are currently believed particularly effective in finishing semiconductor wafer surfaces.

Abrasive particles in the synthetic resin particles having a different composition from optional abrasive particles in the continuous phase of synthetic resin are preferred. An abrasive particle having a Knoop hardness of less than diamond is particularly preferred to reduce microscratches on workpiece surface being finished and a Knoop hardness of less than 50 GPa is more particularly preferred and a Knoop hardness of less than 40 GPa is even more particularly preferred and a Knoop hardness of less than 35 GPa, is especially particularly preferred. An abrasive particle having a Knoop hardness of at least 1.5 GPa is preferred and having a Knoop hardness of at least 2 is more preferred. An abrasive particle having a Knoop hardness of from 1.5 to 50 GPa is preferred and having a Knoop hardness of from 2 to 40 GPa is more preferred and having a Knoop hardness of from 2 to 30 GPa is even more preferred. A fixed abrasive finishing element having a plurality of abrasive particles having at least two different Knoop hardnesses can be preferred. Hard synthetic resin particles can also serve as abrasives.

Hard synthetic resin particles which abrade the workpiece surface can also be effective abrasive particles.

Finishing Element Subsurface Layer

Further illustrative nonlimiting examples of preferred finishing elements for use in the invention are also discussed. A fixed abrasive finishing element comprising a synthetic polymer composition having a plurality of layers is preferred. A fixed abrasive finishing element comprising at least one layer of a soft synthetic polymer is preferred. A fixed abrasive finishing element having a surface layer and a subsurface layer is particularly preferred. A subsurface layer comprising a thermoset resin material is preferred. A subsurface layer comprising a thermoplastic resin material is preferred. The subsurface layer can form an effective reinforcement layer.

A fixed abrasive finishing element subsurface layer comprising a polymer is preferred. This subsurface layer can form a polymeric reinforcing layer for the finishing element. A subsurface layer comprising at least one material selected from the group consisting of an organic synthetic polymer, an inorganic polymer, and combinations thereof is preferred. A preferred example of organic synthetic polymer is an thermoplastic polymer. Another preferred example of an organic synthetic polymer is a thermoset polymer. An organic synthetic polymeric body comprising organic synthetic polymers including materials selected from the group consisting of polyurethanes, polyolefins, polyesters, polyamides, polystyrenes, polycarbonates, polyvinyl chlorides, polyimides, epoxies, chloroprene rubbers, ethylene propylene elastomers, butyl polymers, polybutadienes, polyisoprenes, EPDM elastomers, and styrene butadiene elastomers is preferred. Acrylic polymers, styrene block copolymers and cyclic olefin copolymers are preferred. Thermoplastic elastomers can be a preferred type of matrix for the subsurface layer. Block copolymers are preferred because the physical and chemical performance can be adjusted for the particular workpiece finishing task. Styrene block copolymers are particularly preferred for their broad performance characteristics. Styrene butadiene styrene is a preferred styrene block copolymer. Styrene butadiene rubber is a preferred elastomer. Poly(vinyl acetate) is a preferred polymer. Thermoplastic block copolymers have excellent elastomeric properties such as resistance to flexural fatigue. Polyolefin polymers are particularly preferred for their generally low cost. A preferred polyolefin polymer is polyethylene having broad, cost effective performance characteristics. Ethylene copolymers are a preferred polyolefin polymer. Polymers made by singe site catalysts are preferred polymers. Metallocene copolymers are preferred polymers. They can have high purity with less residue along with carefully customized physical properties for plastics, elastomers, and plastomers. Dow and Exxon manufacture nonlimiting preferred examples of single site catalyzed and metallocene catalyzed polyolefins. A preferred polyolefin polymer is polyethylene. Another preferred polyolefin polymer is a propylene polymer. High density polyethylene and ultra high molecular weight polyethylene are preferred ingredients in the subsurface layer because they are low cost, thermoplastically processible and have a low coefficient of friction. A cross-linked polyolefin, even more preferably cross-linked polyethylene, can be an especially preferred continuous phase synthetic resin matrix. Another preferred polyolefin polymer is a ethylene propylene copolymer. A subsurface layer comprising a polyester resin is preferred. A polyester resin has excellent reinforcement ability and is generally low cost. Copolymer organic synthetic polymers are also preferred. Polyurethanes are preferred for the inherent flexibility in formulations. A finishing element subsurface layer comprising a foamed synthetic resin matrix is particularly preferred because of its flexibility and ability to transport the finishing composition. A foamed polyurethane has desirable abrasion resistance combined with good costs. Foaming agents and processes to foam organic synthetic polymers are generally known in the art. A cross-linked continuous phase synthetic resin matrix is preferred for its generally enhanced thermal resistance. A finishing element comprising a compressible porous material is preferred and one comprising a organic synthetic polymer of a compressible porous material is more preferred. A subsurface layer comprising a continuous phase of thermoplastic resin containing dispersed dynamically vulcanized synthetic resin particles is preferred.

A finishing element subsurface layer comprised of a mixture of a plurality of organic synthetic resins can be particularly tough, wear resistant, reinforcing, and useful. A finishing element subsurface layer comprising a plurality of organic synthetic polymers and wherein the major component is selected from materials selected from the group consisting of polyurethanes, polyolefins, polyesters, polyamides, polystyrenes, polycarbonates, polyvinyl chlorides, polyimides, epoxies, chloroprene rubbers, ethylene propylene elastomers, butyl polymers, polybutadienes, polyisoprenes, EPDM elastomers, and styrene butadiene elastomers is preferred. The minor component is preferably also an organic synthetic resin and is preferably a modifying and/or toughening agent. A preferred example of an organic synthetic polymer modifier is a material which reduces the hardness or flex modulus of the finishing element synthetic resin body such an polymeric elastomer.

A compatibilizing agent can also be used to improve the physical properties of the polymeric mixture. A compatibilizing polymer is a preferred compatibilizing agent. A compatibilizing polymer wherein the polymer which includes chemically distinct sections some of which are miscible with one component and some of which are miscible with a second component in a multiphase polymer mixture is preferred. A compatibilizing polymer "C" which includes chemically distinct sections some of which are miscible with one polymer "A" and some of which are reactive with a second polymer "B" in a multiphase polymer mixture is more preferred. A compatibilizing polymer which chemically reacts with at least one of the immiscible polymers "A" or "B" can be preferred. Diblock copolymers and graft copolymers are examples of preferred types of polymeric compatibilizers. Compatibilizing polymers comprising synthetic polymers and having polar and/or reactive functional groups such as hydroxyl groups, carboxylic acid, maleic anhydride, and epoxy groups are preferred. A compatibilizing polymer having a section which has a higher molecular weight than the molecular weight of the immiscible polymers can be preferred. A graft copolymer is a particularly preferred compatibilizing polymer because they can be made by techniques generally known in the polymer arts at high volume, low cost having electronic purity and many different reactive and/or miscible ends. A polymeric compatibilizing agent having a chemically reactive oxygen functional group is preferred for many polymeric systems. Hydroxyl groups, epoxy groups, carboxylic acid groups and anhydride groups are examples of preferred chemically reactive oxygen functional groups. A polymeric compatibilizing agent having a chemically reactive nitrogen functional group is preferred for many polymeric systems.

A finishing element subsurface layer is preferably attached to the finishing element surface layer. A finishing element having a surface layer connected to the finishing element subsurface reinforcing layer is preferred. Bonding the finishing element surface layer with the finishing element subsurface layer is a preferred method of connecting the two layers. Thermal bonding a particularly preferred method of bonding. Lamination is a preferred method of connecting the two layers. Fabrics, woven fabrics, film layers, and long fiber reinforcement members are preferred examples of finishing element subsurface layers. A continuous belt can have substantially continuous fibers therein. Aramid fibers are particularly preferred for their low stretch and: excellent strength. The finishing element subsurface layer can attached with illustrative generally known adhesives and various generally known processes such as extrusion coating, bonding, and laminating. Tie layers of different reactive resins are known to those skilled in the adhesive arts. Tie layers often contain reactive functional groups.

Oxygen containing functional groups are preferred nonlimiting examples. Preferred nonlimiting oxygen containing functional groups include epoxy, carboxylic acid, anhydride, and alcohols.

Optional Discrete Stiffening Members

To improve within die nonuniformity when polishing semiconductor wafers, a plurality of discrete stiffening members can be used and is preferred. The discrete stiffening members preferably are uniformly shaped. A rectangle is a preferred uniform shape. A circle is a preferred uniform shape. An oval is a preferred uniform shape. A shape combining elements of an oval and a rectangular shape is a preferred uniform shape. The discrete stiffening members can be arranged randomly or in a pattern on the unitary resilient body. The discrete stiffening members preferably do not touch their nearest discrete stiffening member neighbors. In other words, the discrete stiffening members are separated in space from their nearest discrete stiffening member neighbors. FIG. 5 is an artist's cutaway view of one embodiment of a finishing element having discrete stiffening members positioned between the finishing element finishing surface layer (Reference Numeral 33) and finishing element sublayer (Reference Numeral 104). Reference Numeral 26 represents the finishing element finishing surface. Reference Numeral 34 represents the discrete synthetic resin particles in the continuous phase of synthetic resin (abrasive particles, not shown, are contained therein). Reference Numeral 100 represents the discrete stiffening member. Reference Numeral 102 represents spacing between the adjacent discrete stiffening members which facilitate flexing of the finishing element (which does not have a discrete stiffening member). Reference Numeral 102 can also form preferred supply channels for supplying a finishing composition to the operative finishing interface during finishing. Discrete stiffening members having a flexural modulus of greater than that of the finishing surface layer are preferred. This creates a discrete stiffened region (Reference Numeral 110) and an unstiffened region (Reference Numeral 112) in the finishing element. Discrete stiffening members having a flexural modulus of greater than that of the sublayer are preferred. Discrete stiffening members having a stiffening additive are preferred. Inorganic particles and fibers are illustrative examples of preferred stiffening agents. Illustrative preferred examples of stiffening fibers include inorganic fibers and organic fibers. Organic synthetic fibers are preferred examples of organic fibers. Glass fibers and silica fibers comprise illustrative examples of inorganic fibers. Silica particles are an illustrative example of a preferred inorganic particle. Carbon fibers and boron fibers are preferred examples of stiffening fiber additives. As shown in FIG. 5, the discrete stiffening members—particularly reinforced with hard material capable of scratching the workpiece surface during finishing—are preferably at a distance from the finishing element finishing surface to prevent scratching of the workpiece surface during finishing. In other words, the discrete stiffening members having hard material capable of causing unwanted sure damage to the workpiece surface separated from the workpiece surface in a manner to prevent this unwanted surface damage. Discrete stiffening members comprised of an engineering polymer are preferred and those comprised of a reinforced engineering polymer are more preferred. Discrete stiffening members comprised of a toughened engineering polymer are more preferred. Stiffening members are preferably fixedly attached to the finishing element finishing surface layer. Bonding is a preferred form of fixed attachment. Polymers and polymer systems which can stiffen regions of particular finishing elements have been described elsewhere herein in further detail.

Discrete stiffening members form high flexural modulus local regions in the finishing element. A flexural modulus ratio of the discrete stiffening member region to the unstiffened region in the finishing element of from 2/1 to 500/1 is preferred and a flexural modulus ratio of the discrete stiffening member region to the unstiffened region in the finishing element of from 3/1 to 200/1 is more preferred and a flexural modulus ratio of the discrete stiffening member region to the unstiffened region in the finishing element of from 3/1 to 200/1 is even more preferred. ASTM flexural modulus testing is used. Flexural modulus for polymeric systems is preferably measured with ASTM 790 B at 73 degrees Fahrenheit.

The ratio of the area of the surface of the discrete stiffening member to the area of the surface of the semiconductor die being finished can give useful guidance for finishing improvements. Each discrete stiffening member having a surface area of less than the surface area of the semiconductor wafer being finished is preferred. Each discrete stiffening member having a surface area of less than the surface area of the semiconductor wafer being finished and at least the surface area of the die being finished is more preferred. A ratio of the area of the surface of the discrete stiffening members to area of the die of at least 1/1 is preferred and of at least 2/1 is more preferred and of at least 3/1 is even more preferred and of at least 4/1 is even more particularly preferred. A ratio of the area of the surface of the discrete stiffening members to area of the die of from 1/1 to 20/1 is preferred and of from 2/1 to 15/1 is more preferred and of from 3/1 to 10/1 is even more preferred and of from 4/1 to 10/1 is even more preferred. A discrete stiffening member having a surface area sufficient to simultaneously cover at least two regions of high device integration during finishing of the semiconductor wafer is preferred and a surface area sufficient to simultaneously cover at least five regions of high device integration during finishing of the semiconductor wafer is more preferred and a surface area sufficient to simultaneously cover at least ten regions of high device integration during finishing of the semiconductor wafer is even more preferred. A discrete stiffening member having a surface area sufficient to simultaneously cover from 2 to 100 regions of high device integration during finishing of the semiconductor wafer is preferred and a surface area sufficient to simultaneously cover 2 to 50 regions of high device integration during finishing of the semiconductor wafer is more preferred and a surface area sufficient to simultaneously cover from 5 to 50 regions of high device integration during finishing of the semiconductor wafer is even more preferred. A discrete stiffening member having a surface area sufficient to simultaneously cover from 2 to 100 regions of high pattern density during finishing of the semiconductor wafer is preferred and a surface area sufficient to simultaneously cover 2 to 50 regions of high pattern density during finishing of the semiconductor wafer is more preferred and a surface area sufficient to simultaneously cover from 5 to 50 regions of high pattern density during finishing of the semiconductor wafer is even more preferred. A line pattern density and an oxide pattern density are preferred types of pattern density. The size of the preferred discrete stiffening member is also dependent on the specific design and layout of the die and the wafer but applicant believes that the above ratios will serve as helpful general guidance.

Discrete stiffening members can customize the local stiffness of the finishing element to improve within die nonuniformity while allowing the finishing element to flex between them to help improve global planarity. The discrete stiffening members can be any flat discrete shape such as disk shaped, oval shaped, rectangularly shaped, and the like. Preferably the discrete stiffening members are spaced apart as shown in FIG. 5 to facilitate finishing element flexing on a global scale which can help improve global finishing of the workpiece surface. Preferably the discrete stiffening members are flexible, particularly when used in a continuous finishing belt application to reduce or eliminate a set which could damage the workpiece surface being finished.

Stabilizing Fillers

A fibrous filler is a preferred stabilizing filler for the synthetic resins of this invention. A fibrous filler is a particularly preferred additive to the synthetic resin of the continuous phase synthetic resin matrix in the finishing element surface and also in the synthetic resin of the subsurface layer. A plurality of synthetic fibers is a particularly preferred fibrous filler. Fibrous fillers tend to help generate a lower abrasion coefficient and/or stabilize the finishing element finishing surface from excessive wear. By reducing wear the finishing element has improved stability during finishing. A fibrous filler comprising fibers which are softer than the hardest material in the workpiece surface being finished is preferred and a fibrous filler which is softer than the softest material in the workpiece surface being finished is more preferred. A fibrous filler comprising synthetic fibers is preferred. By having the fibers softer, scratching of the workpiece can be reduced or eliminated. Synthetic fibers are generally commercially available with good reinforcing potential, at modest cost, and in high volumes. A fibrous filler is a preferred wear reducing agent for synthetic resin structures used herein.

A preferred stabilizing filler is a dispersion of fibrous filler material dispersed in the finishing element. Organic synthetic resin fibers are a preferred fibrous filler. Preferred fibrous fillers include fibers selected from the group consisting of aramid fibers, polyester fibers, and polyamide fibers. Preferably the fibers have a fiber diameter of from 1 to 15 microns and more preferably, from 1 to 8 microns. Preferably the fibers have a length of less than 1 cm and more preferably a length from 0.1 to 0.6 cm and even more preferably a length from 0.1 to 0.3 cm. Particularly preferred are short organic synthetic resin fibers that can be dispersed in the finishing element and more preferably mechanically dispersed in at least a portion of the finishing element proximate the finishing element finishing surface and more preferably, mechanically substantially uniformly dispersed in at least a portion of the finishing element proximate to the finishing element finishing surface and even more preferably, mechanically substantially uniformly dispersed in at least a portion of the finishing element proximate to the finishing element finishing surface. The short organic synthetic fibers are added in the form of short fibers substantially free of entanglement and dispersed in the finishing element matrix. Preferably, the short organic synthetic fibers comprise fibers of at most 0.6 cm long and more preferably 0.3 cm long. An aromatic polyamide fiber is particularly preferred. Aromatic polyamide fibers are available under the tradenames of "Kevlar" from DuPont in Wilmington, Del. and "Teijin Cornex" from Teijin Co. Ltd. The organic synthetic resin fibers can be dispersed in the synthetic by methods generally known to those skilled in the art. As a nonlimiting example, the cut fibers can be dispersed in a thermoplastic synthetic resin particles of under 20 mesh, dried, and then compounded in a twin screw, counter rotating extruder to form extruded pellets having a size of from 0.2–0.3 cm. Optionally, the pellets can be water cooled, as appropriate. These newly formed thermoplastic pellets having substantially uniform discrete, dispersed, and unconnected fibers can be used to extruded or injection mold a fixed abrasive element of this invention. Aramid powder can also be used to stabilize the finishing element organic synthetic polymers to wear. Organic synthetic resin fibers are preferred because they tend to reduce unwanted scratching to the workpiece surface.

U.S. Pat. No. 4,877,813 to Jimmo, U.S. Pat. No. 5,079,289 to Takeshi et al., and U.S. Pat. No. 5,523,352 to Janssen are included herein by reference in their entirety for general guidance and appropriate modification by those skilled in the art.

Finishing Aids

A fixed abrasive finishing element having an effective amount of finishing aid, preferably a lubricating aid, is a preferred embodiment of this invention. Supplying an effective amount of finishing aid from the finishing element finishing surface layer, more preferably a lubricating aid, which reduces the coefficient of friction between the finishing element finishing surface and the workpiece surface being finished is preferred. Supplying an effective amount of finishing aid from the finishing element finishing surface layer, more preferably a lubricating aid, which reduces the unwanted surface damage to the surface of the workpiece being finished during finishing is preferred. Supplying an effective amount of finishing aid from the finishing element finishing surface layer, more preferably a lubricating aid, which differentially lubricates different regions of the work piece and reduces the unwanted surface damage to at least a portion of the surface of the workpiece being finished during finishing is preferred.

Supplying a finishing aid from the finishing element finishing surface to the interface of the workpiece surface being finished and the finishing element finishing surface to extend the finishing element finishing surface useful life is preferred. Supplying a finishing aid from the finishing element finishing surface to the interface of the workpiece surface being finished and the finishing element finishing surface to reduce unwanted surface defects in the workpiece surface being finished is preferred. Supplying of finishing aid from the finishing element finishing surface to the interface of the workpiece surface being finished and the finishing element finishing surface to reduce unwanted breaking away of abrasive particles from the fixed abrasive finishing element finishing surface is preferred. An effective amount of finishing aid from the finishing element finishing surface often can help meeting a plurality of these objectives simultaneously.

A finishing aid dispersed in discrete regions of the continuous phase synthetic resin matrix of the fixed abrasive surface layer is preferred. A finishing aid uniformly dispersed in discrete regions of the continuous phase synthetic resin matrix of the fixed abrasive surface layer is more preferred. A finishing aid dispersed in discrete, unconnected regions of the continuous phase synthetic resin matrix of the fixed abrasive surface layer is even more preferred. This type of dispersion is relatively cost effective to make using mixing technology generally known to those skilled in the art (such as single and twin screw extruders). High shear processing and mixing such as that found in a twin screw extruder is generally preferred.

The finishing aid, more preferably a lubricating aid, can help reduce the formation of surface defects for high precision part finishing. Fluid based finishing aid, more preferably a lubricating aid, can help reduction of brittle fracture at the workpiece surface being finished. A method of finishing which adds an effective amount of fluid based finishing aid, more preferably a lubricating aid, to the interface between the finishing element finishing surface and workpiece surface being finished is preferred. A preferred effective amount of fluid based finishing aid, more preferably a lubricating aid, reduces the occurrence of unwanted surface defects. A preferred effective amount of fluid based finishing aid, more preferably a lubricating aid, reduces the coefficient of friction between the work piece surface being finished and the finishing element finishing surface.

Certain particularly preferred workpieces in the semiconductor industry have regions of high conductivity and regions of low conductivity. The higher conductivity regions are often comprised of metallic materials such as tungsten, copper, aluminum, and the like. An illustrative example of a common lower conductivity region is silicon and silicon oxide. A fluid based lubrication which differentially lubricates the two regions is preferred and a fluid based lubricant which substantially differentially lubricates two regions is more preferred. An example of a differential lubrication is if the coefficient of friction is changed by different amounts in one region versus the other region during finishing. For instance one region can have the coefficient of friction reduced by 20% and the other region reduced by 40%. This differential change in lubrication can be used to help in differential finishing of the two regions. An example of differential finishing is a differential finishing rate between the two regions. For example, a first region can have a finishing rate of "X" angstroms/minute and a second region can have a finishing rate of "Y" angstroms per minute before lubrication and after differential lubrication, the first region can have a finishing rate of 80% of "Y" and the second region can have a finishing rate of 60% of "Y". An example of where this will occur is when the lubricant tends to adhere to one region because of physical or chemical surface interactions (such as a metallic conductive region) and not adhere or not adhere as tightly to the an other region (such as a non metallic, non conductive region). Changing the finishing control parameters to change the differential lubrication during finishing of the workpiece is a preferred method of finishing. Changing the finishing control parameters to change the differential lubrication during finishing of the workpiece which in turn changes the region finishing rates in the workpiece is a more preferred method of finishing. Changing the finishing control parameters with in situ process control to change the differential lubrication during finishing of the workpiece which in turn changes the region finishing rates in the workpiece is an even more preferred method of finishing. A secondary friction sensor probe can aid in a particularly preferred way in detecting and controlling differential lubrication in the workpieces having heterogeneous surface compositions needing finishing.

A lubricating aid comprising a reactive lubricant is preferred. A lubricating aid comprising a boundary lubricant is also preferred. A reactive lubricant is a lubricant which chemically reacts with the workpiece surface being finished. A boundary layer lubricant is a preferred example of a lubricant which can form a lubricating film on the surface of the workpiece surface. As used herein a boundary lubricant is a thin layer on one or more surfaces which prevents or at least limits, the formation of strong adhesive forces between the workpiece being finished and the finishing, element finishing surface and therefore limits potentially damaging friction junctions between the workpiece surface being finished and the finishing element finishing surface. A boundary layer film has a comparatively low shear strength in tangential loading which reduces the tangential force of friction between the workpiece being finished and the finishing element finishing surface which can reduce surface damage to the workpiece being finished. In other words, boundary lubrication is a lubrication in which friction between two surfaces in relative motion, such as the workpiece surface being finished and the finishing element finishing surface, is determined by the properties of the surfaces, and by the properties of the lubricant other than the viscosity. Organic lubrication layers wherein the friction between two surfaces is dependent on lubricant properties other than viscosity is preferred. Different regional boundary layers on a semiconductor wafer surface being finished can be preferred for some finishing—particularly planarizing. A boundary film generally forms a thin film, perhaps even several molecules thick, and the boundary film formation depends on the physical and chemical interactions with the surface. A boundary lubricant which forms a thin film is preferred. A boundary lubricant forming a film having a thickness from 1 to 10 molecules thick is preferred and a boundary lubricant forming a film having a thickness from 1 to 6 molecules thick is more preferred and a boundary lubricant forming a film having a thickness from 1 to 4 molecules thick is even more preferred. A boundary lubricant forming a film having a thickness from 1 to 10 molecules thick on at least a portion of the workpiece surface being finished is particularly preferred and a boundary lubricant forming a film having a thickness from 1 to 6 molecules thick on at least a portion of the workpiece surface being finished is more particularly preferred and a boundary lubricant forming a film having a thickness from 1 to 4 molecules thick on at least a portion of the workpiece surface being finished is even more particularly preferred. A boundary lubricant forming a film having a thickness of at most 10 molecules thick on at least a portion of the workpiece surface being finished is particularly preferred and a boundary lubricant forming a film having a thickness of at most 6 molecules thick on at least a portion of the workpiece surface being finished is more particularly preferred and a boundary lubricant forming a film having a thickness of at most 4 molecules thick on at least a portion of the workpiece surface being finished is even more particularly preferred. An operative motion which continues in a substantially uniform direction can improve boundary layer formation and lubrication. Boundary lubricants, because of the small amount of required lubricant, are particularly effective finishing aids for inclusion in fixed abrasive finishing elements.

A boundary lubricant which forms a thin lubricant film on the metal conductor portion of a workpiece surface being finished is particularly preferred. A nonlimiting preferred group of example boundary lubricants include at least one lubricant selected from the group consisting of fats, fatty acids, esters, and soaps. A phosphorous containing compound can be an effective preferred boundary lubricant. A phosphate ester is an example of a preferred phosphorous containing compound which can be an effective boundary lubricant. A chlorine containing compound can be an effective preferred boundary lubricant. A sulfur containing compound can be an effective preferred boundary lubricant. A compound containing atoms selected from the group consisting of elements oxygen, fluorine, or chlorine can be an effective finishing aid. A synthetic organic polymer containing atoms selected from the group consisting of oxygen, fluorine, or chlorine can be an effective finishing aid. A sulfated vegetable oil and sulfurized fatty acid soaps are preferred examples of a sulfur containing compound. Boundary lubricant and lubricant chemistries are discussed further herein below. A lubricant which reacts physically with at least a portion of the workpiece surface being finished is a preferred lubricant. A lubricant which reacts chemically with at least a portion of the workpiece surface being finished is often a more preferred lubricant because it is often a more effective lubricant and can also aid at times directly in the finishing.

A marginally effective lubricant between the workpiece being finished and the finishing element finishing surface is preferred. As used herein, a marginally effective lubricant is a lubricant and an amount which does not perfectly lubricant and stop all wear but allows some wear while reducing or eliminating especially deleterious wear.

Limited zone lubrication between the workpiece being finished and the finishing element finishing surface is preferred. As used herein, limited zone lubrication is lubrication to reduce friction between two surfaces while simultaneously having wear occur. Limited zone lubricating which simultaneously reduces friction between the operative finishing interface while maintaining a cut rate on the workpiece surface being finished is preferred. Limited zone lubricating which simultaneously reduces friction between the operative finishing interface while maintaining an acceptable cut rate on the workpiece surface being finished is more preferred. Limited zone lubricating which simultaneously reduces friction between the operative finishing interface while maintaining a finishing rate on the workpiece surface being finished is preferred. Limited zone lubricating which simultaneously reduces friction between the operative finishing interface while maintaining an acceptable finishing rate on the workpiece surface being finished is more preferred. Limited zone lubricating which simultaneously reduces friction between the operative finishing interface while maintaining a planarizing rate on the workpiece surface being finished is preferred. Limited zone lubricating which simultaneously reduces friction between the operative finishing interface while maintaining an acceptable planarizing rate on the workpiece surface being finished is more preferred. Limited zone lubricating which simultaneously reduces friction between the operative finishing interface while maintaining a polishing rate on the workpiece surface being finished is preferred. Limited zone lubricating which simultaneously reduces friction between the operative finishing interface while maintaining an acceptable polishing rate on the workpiece surface being finished is preferred. Lubricant types and concentrations are preferably controlled during limited zone lubricating. Limited zone lubricating offers the advantages of controlled wear along with reduced unwanted surface damage.

Lubricants which are polymeric can be very effective lubricants. Supplying a lubricant to the interface of the workpiece surface being finished and the finishing element finishing surface wherein the lubricant is from 0.1 to 15% by weight of the total fluid between the interface is preferred and from 0.2 to 12% by weight of the total fluid between the interface is more preferred and from 0.3 to 12% by weight of the total fluid between the interface is even more preferred and from 0.3 to 9% by weight of the total fluid between the interface is even more particularly preferred. These preferred ranges are given for general guidance and help to those skilled in the art. Lubricants outside this range are currently believed to be useful but not as economical to use.

A lubricant having a molecular weight of at least 250 is often preferred. A lubricant having functional groups containing elements selected from the group consisting of chlorine, sulfur, and phosphorus is preferred and a boundary lubricant having functional groups containing elements selected from the group consisting of chlorine, sulfur, and phosphorous is more preferred. A lubricant comprising a fatty acid substance is a preferred lubricant. An preferred example of a fatty substance is a fatty acid ester or salt. Fatty acid salts of plant origin can be particularly preferred. A lubricant comprising a synthetic polymer is preferred and a lubricant comprising a boundary lubricant synthetic polymer is more preferred and a lubricant comprising a boundary lubricant synthetic polymer and wherein the synthetic polymer is water soluble is even more preferred. A polymer having a number average molecular weight from 400 to 150,000 is preferred and having a number average molecular weight from 1,000 to 100,000 is more preferred and having a number average molecular weight from 1,000 to 50,000 is even more preferred.

A lubricant comprising a polyalkylene glycol polymer is a preferred composition. A polymer of polyoxyalkylene glycol monoacrylate or polyoxyalkylene glycol monomethacrylate is very useful as a base of lubricant. A polyethylene glycol having a molecular weight of 200 to 2000 is preferred. Polyglycol having a molecular weight of at least 600 is preferred and a polyglycol having a molecular weight above 800 is more preferred. Polyglycols selected from the group polymers consisting of ethylene oxide, propylene oxide, and butylene oxide and mixtures thereof are particularly preferred. A fatty acid ester can be an effective lubricant. Polyglycol derivatives are also preferred. An amine modified polyglycol is an example of a preferred polyglycol.

A preferred finishing aid is a lubricating aid which can be included in the finishing element. A finishing aid distributed in at least a portion of the finishing element proximate to the finishing element finishing surface is preferred and a finishing aid distributed substantially uniformly in at least a portion of the finishing element proximate the finishing element finishing surface is more preferred and a finishing aid distributed uniformly in at least a portion of the finishing element proximate to the finishing element finishing surface is even more preferred. A finishing aid selected from the group consisting of liquid and solid lubricants and mixtures thereof is a preferred finishing aid.

A combination of a liquid lubricant and ethylene vinyl acetate, particularly ethylene vinyl acetate with 15 to 50% vinyl acetate by weight, can be a preferred effective lubricating aid additive. Preferred liquid lubricants include paraffin of the type which are solid at normal room temperature and which become liquid during the production of the finishing element. Typical examples of desirable liquid lubricants include paraffin, naphthene, and aromatic type oils, e.g. mono- and polyalcohol esters of organic and inorganic acids such as monobasic fatty acids, dibasic fatty acids, phthalic acid and phosphoric acid.

The lubricating aid can be contained in the finishing element in different preferred forms. A lubricating aid dispersed in an organic synthetic polymer is preferred. A lubricating aid which is a liquid lubricant can be dispersed throughout the primary organic synthetic resin wherein the liquid lubricant effect of the binding of the fixed abrasive is carefully controlled. A fixed abrasive free a of coating having finishing aids is preferred and fixed abrasive particles free of a coating having a finishing aid is more preferred. A lubricating aid dispersed in a minor amount of organic synthetic polymer which is itself dispersed in the primary organic synthetic polymer in discrete, unconnected regions is more preferred. As an illustrative example, a lubricant dispersed in a minor amount of an ethylene vinyl acetate and wherein the ethylene vinyl acetate is dispersed in discrete, unconnected regions in a polyacetal resin. A lubricating aid dispersed in discrete, unconnected regions in an organic synthetic polymer is preferred. By dispersing the finishing aid and/or lubricating aids in a plurality of discrete, unconnected regions, their impact on the binding of the fixed abrasive in the body of the fixed abrasive element is reduced or eliminated.

A polyglycol is an example of a preferred finishing aid. Preferred polyglycols include glycols selected from the group consisting of polyethylene glycol, an ethylene oxide-propylene butyl ethers, a diethylene glycol butyl ethers, ethylene oxide-propylene oxide polyglycol, a propylene glycol butyl ether, and polyol esters. A mixture of polyglycols is a preferred finishing aid. Alkoxy ethers of polyalkyl glycols are preferred finishing aids. An ultra high molecular weight polyethylene, particularly in particulate form, is an example of a preferred finishing aid. A fluorocarbon resin is an example of a preferred lubricating agent. Fluorocarbons selected from the group consisting of polytetrafluoroethylene (PTFE), ethylene tetrafluoride/propylene hexafluoride copolymer resin (FEP), an ethylene tetrafluoride/perfluoroalkoxyethylene copolymer resin (PFA), an ethylene tetra fluoride/ethylene copolymer resin, a trifluorochloroethylene copolymer resin (PCTFE), and a vinylidene fluoride resin are examples of preferred fluorocarbon resin finishing aids. A polyphenylene sulfide polymer is a preferred polymeric lubricating aid. Polytetrafluoroethylene is a preferred finishing aid. Polytetrafluoroethylene in particulate form is a more preferred finishing aid and polytetrafluoroethylene in particulate form which resists reagolmeration is an even more preferred finishing aid. A silicone oil is a preferred finishing aid. A polypropylene is a preferred finishing aid, particularly when blended with polyamide and more preferably with nylon 66. A lubricating oil is a preferred finishing aid. A polyolefin polymer can be a preferred effective lubricating aid, particularly when incorporated into polyamide resins and elastomers. A high density polyethylene polymer is a preferred polyolefin resin. A polyolefin/polytetrafluoroethylene blend is also a preferred lubricating aid. Low density polyethylene can be a preferred lubricating aid. A fatty acid substance can be a preferred lubricating aid. An example of a preferred fatty acid substance is a fatty ester derived from a fatty acid and a polyhydric alcohol. Examples of fatty acids used to make the fatty ester are lauric acid, tridecylic acid, myristic acid, pentadecylic acid, palmitic acid, margaric acid, stearic acid, nonadecylic acid, arachidic acid, oleic acid, elaidic acid and other related naturally occurring fatty acids and mixtures thereof Examples of preferred polyhydric alcohols include ethylene glycol, propylene glycol, homopolymers of ethylene glycol and propylene glycol or polymers and copolymers thereof and mixtures thereof.

Illustrative, nonlimiting examples of finishing aids including organic synthetic resin systems and general useful related technology are given in the U.S. Pat. No. 3,287,288 to Reilling, U.S. Pat. No. 3,458,596 to Eaigle, U.S. Pat. No. 4,877,813 to Jimo et. al., U.S. Pat. No. 5,079,287 to Takeshi et al., U.S. Pat. No. 5,110,685 to Cross et al., U.S. Pat. No. 5,216,079 to Crosby et al., U.S. Pat. No. 5,523,352 to Janssen, and U.S. Pat. No. 5,591,808 to Jamison and are included herein by reference in their entirety for guidance and modification as appropriate by those skilled in the art. Some preferred suppliers of lubricants include Dow Chemical, Huntsman Corporation, and Chevron Corporation.

Generally those skilled in the art know how to measure the kinetic coefficient of friction. A preferred method is ASTM D 3028-95 and ASTM D 3028-95 B is particularly preferred. Those skilled in the art can modify ASTM D 3028-95 B to adjust to appropriate finishing velocities and to properly take into consideration appropriate fluid effects due to the lubricant and finishing composition. Preferred lubricants and finishing compositions do not corrode the workpiece or localized regions of the workpiece. Corrosion can lead to workpiece failure even before the part is in service. ASTM D 130 is a is a useful test for screening lubricants for particular workpieces and workpiece compositions. As an example a metal strip such as a copper strip is cleaned and polished so that no discoloration or blemishes are detectable. The finishing composition to be tested is then added to a test tube, the copper strip is immersed in the finishing composition, and the test tube is then closed with a vented stopper. The test tube is then heated under controlled conditions for a set period of time, the metal strip is removed, the finishing composition removed, and the metal strip is compared to standards processed under identical conditions to judge the corrosive nature and acceptableness of the finishing composition. ASTM D 1748 can also be used to screen for corrosion. Alternately a solid lubricant can be deposited on a surface to be screened for corrosive effects and the target sample tested under appropriate conditions. These test methods are included herein by reference in their entirety.

Supplying an effective marginal lubrication to the interface between the workpiece surface being finished and the finishing element finishing surface is preferred and supplying an effective marginal boundary lubrication to the interface between the workpiece surface being finished and the finishing element finishing surface is more preferred. Marginal lubrication is less than complete lubrication and facilitates controlling frictional wear and tribochemical reactions. Independent control of the lubricant control parameters aids in controlling an effective amount of marginal lubrication and in situ control of the lubricant control parameters is more preferred.

Further Comments on Some Preferred Methods to Manufacture Multiphase Synthetic Resin Polymeric Finishing Elements Finishing element for finishing semiconductor wafers must have a very high degree of cleanliness and/or purity to finish semiconductor wafers at high yields. Corrosive contaminates and/or contaminate particles unintentionally in the finishing element can cause yield losses costing thousands of dollars. Purifying the ingredients in the finishing element prior to manufacture of the finishing element is preferred. Melt purifying the synthetic resin before melt mixing multiple synthetic resins is a preferred example of a purifying step. Vacuum melt purifying is a preferred example of a melt purifying step. Melt vacuum screw extrusion is a preferred form of melt purifying the synthetic resin. Melt vacuum screw extrusion can remove or reduce unwanted low molecular weight substances such as unreacted oligomers and unreacted monomers. Unwanted low molecular weight side reaction products developed during polymeric graft reactions can also be removed with vacuum screw extrusion. Filter purifying is a preferred form of purifying the synthetic resin. Filter purifying, preferably melt filtering, can remove unwanted hard particulate contaminants from the synthetic resin or ingredients to the synthetic resin which can cause scratching during subsequent finishing. A screen pack can be used for filtering the melt. A screen pack designed for melt extrusion is a preferred example of melt filtering. Melt filter purifying to remove all visible unmelted hard particle contaminants is preferred. Filter purifying to remove unmelted hard particle contaminants of less than 20 microns in diameter is preferred and of at most 10 micron is more preferred.

Melt purifying the synthetic resins with melt purifying equipment is preferred before dynamic formation of the two phase because it is more difficult to filter the two phase system. Polymers can also be purified by extraction techniques (such as liquid extraction and selective precipitation) to remove unwanted contaminants. A vacuum extruder and polymer melt filters are preferred examples of melt purifying equipment. U.S. Pat. No. 5,266,680 to Al-Jimal et al., U.S. Pat. No. 5,756,659 to Hughes, U.S. Pat. No. 5,869,591 to McKay et al., and U.S. Pat. No. 5,977,271 to McKay et al. give further non-limiting guidance for some preferred purifying methods and equipment and are included herein in the entirety by reference.

Multiphase synthetic resin polymer mixtures can be manufactured by preferred polymeric processing methods. Preformed synthetic resin particles can be mixed with the continuous phase synthetic resin in melt processing equipment such as extruders and melt blending apparatus. Preformed synthetic resin particles can be added under mixing conditions to a thermoset resin and mixed therein prior to curing. The preformed particles can contain preferred additives such as abrasive particles. Under high shear and temperature mixing conditions, a two phase synthetic resin mixture having discrete synthetic resin particles comprised of polymer "B" dispersed in a continuous phase of a separate synthetic resin polymer "A". Further, polymer "B" can contain preferred additives such as abrasives or fibers prior to the high shear melt mixing process. Alternately one or both synthetic resin polymers can be functionalized to graft with one of the polymers. The functional group can be capable of reacting during mixing with other functional groups. A block copolymer can be used to compatibilize the multiphase polymeric mixture. Optionally, crosslinking agents can be used to enhance crosslinking. Crosslinking agents are generally specific to polymer or polymeric system to be crosslinked and are generally well known by those skilled in the crosslinking arts. Illustrative examples of chemical crosslinking agents include peroxides, phenols, azides, and active compositions including sulfur, silicon, and/or nitrogen. Optionally, initiators can also be used to enhance crosslinking. Optionally, radiation can be used to enhance crosslinking. Generally, the radiation type and dosage is specific to the polymer system undergoing crosslinking. Crosslinking systems include the ingredients for crosslinking such as crosslinking agents, crosslinking initiators, and energy for crosslinking for effective crosslinking for the polymer or polymeric system being crosslinked and generally well known for different polymeric and elastomeric systems. Crosslinking systems can employ moisture, heat, radiation, and crosslinking agents or combinations thereof the effect crosslinking. An agent for crosslinking can be preferred for specific finishing element components. The multiphase synthetic resin mixtures can have preferred morphologies and compositions to change wear, friction, flexural modulus, hardness, temperature sensitivity, toughness, and resistance to fatigue failure during finishing to improve finishing.

Illustrative examples of multiphase polymeric constructions, their manufacture, compatibilization, and dynamic crosslinking can be found in various United States Patents. Included are various crosslinking systems, compatibilizers, and specific guidance on mixing conditions for multiphase polymeric systems. U.S. Pat. No. 3,882,194 to Krebaum, U.S. Pat. No. 4,419,408 to Schmukler et al., U.S. Pat. No. 4,440,911 to Inoue et al., U.S. Pat. No. 4,632,959 to Nagano, U.S. Pat. No. 4,472,555 to Schmukler et al., U.S. Pat. No. 4,762,890 to Strait et al., U.S. Pat. No. 4,477,532 to Schmukler et al, U.S. Pat. No. 4,851,468 to Hazelton et al., U.S. Pat. No. 5,100,947 to Puydak et al., U.S. Pat. No. 5,128,410 to Illendra et al., U.S. Pat. No. 5,244,971 to Jean-Marc, U.S. Pat. No. 5,266,673 to Tsukahara et al., U.S. Pat. No. 5,286,793 to Cottis et al., U.S. Pat. No. 5,321,081 to Chundry et al., U.S. Pat. No. 5,376,712 to Nakajima, U.S. Pat. No. 5,416,171 to Chung et al., U.S. Pat. No. 5,460,818 to Park et al., U.S. Pat. No. 5,504,139 to Davies et al., U.S. Pat. No. 5,523,351 to Colvin et al., U.S. Pat. No. 5,548,023 to Powers et al., U.S. Pat. No. 5,585,152 to Tamura et al., U.S. Pat. No. 5,605,961 to Lee et al., U.S. Pat. No. 5,610,223 to Mason, U.S. Pat. No. 5,623,019 to Wiggins et al., U.S. Pat. No. 5,625,002 to Kadoi et. al., U.S. Pat. No. 5,683,818 to Bolvari, U.S. Pat. No. 5,723,539 to Gallucci et al, U.S. Pat. No. 5,578,680 to Ando et al., U.S. Pat. No. 5,783,631 to Venkataswamy, U.S. Pat. No. 5,852,118 to Horrion et al., U.S. Pat. No. 5,777,029 to Horrion et al., U.S. Pat. No. 5,777,039 to Venkataswamy et al., U.S. Pat. No. 5,837,179 to Pihl et al., U.S. Pat. No. 5,856,406 to Silvis et al., U.S. Pat. No. 5,869,591 to McKay et al., U.S. Pat. No. 5,929,168 to Ikkala et al., U.S. Pat. No. 5,936,038 to Coran et al., U.S. Pat. No. 5,936,039 to Wang et al., U.S. Pat. No. 5,936,058 to Schauder, and U.S. Pat. No. 5,977,271 to McKay et al. comprise illustrative examples and these patents are contained herein by reference in their entirety for further general guidance and modification by those skilled in the arts. Examples of dynamic crosslinking to enhance elastic deformation, enhance damping, crosslinking systems, agents for crosslinking given in helpful detail.

Mixing technology to disperse the synthetic resin particles in a continuous phase synthetic resin matrix is generally well known to those skilled in the polymer mixing arts. Thermoset synthetic resin particles are currently preferred. Crosslinked synthetic resin particles are also currently preferred. Single and twin screw extruders are commonly used for many thermoplastic mixing operations. High shear mixing such as often found in twin screw extruders is generally desirable. Hoppers and ports to feed multiple ingredients are generally well known in the art. The ingredients can be added in a feed hopper or optionally mixed in the melt using feed ports in the extruder. Commercial suppliers of mixing equipment for plastic materials are well known to those skilled in the art. Illustrative nonlimiting examples of mixing equipment suppliers include Buss (America), Inc., Berstorff Corporation, Krupp Werner & Pfleiderer, Kady International, and Farrel Corporation. Synthetic resin polymers of the above descriptions are generally available commercially. Illustrative nonlimiting examples of commercial suppliers of organic synthetic polymers include Exxon Co., Dow Chemical, Sumitomo Chemical Company, Inc., DuPont Dow Elastomers, and BASF.

Because of the lower cost of manufacture and improved contamination control, applicant currently prefers new dynamic formation of multiphase polymeric mixtures during melt mixing. Dynamically forming synthetic resin polymer "A" particles in a continuous phase of synthetic resin polymer "B" in the presence of a compatibilizer polymer "C" is a preferred method of forming a multiphase polymeric matrix for a finishing element component such as a subsurface layer or a finishing surface layer. Dynamically vulcanizing synthetic resin polymer "A" particles in a continuous phase of synthetic resin polymer "B" is a preferred method of forming forming a multiphase polymeric matrix for a finishing element such as a lower layer or a finishing layer. Dynamically vulcanizing synthetic resin polymer "A" particles in a continuous phase of synthetic resin polymer "B" in the presence of a compatibilizer polymer "C" is also preferred method of forming forming a multiphase polymeric matrix for a finishing element such as a lower layer or a finishing layer. Compatibilizers can improve the physical properties of the composite by improving toughness of the finishing element during finishing which in turn can lower the costs to make planarized and polished semiconductor wafers. Dynamic vulcanization can also improve toughness of the composite structure.

Supplying a synthetic resin "A", a synthetic resin "B", abrasive particles, and a polymeric compatibilizer "C" to a melt mixer is a preferred step in forming a finishing element component. Dynamically melt mixing and dispersing the synthetic resin "B" into synthetic resin "A" having a plurality of synthetic resin phases is a preferred step in forming a finishing element component. Dynamically melt mixing the abrasive particles into a synthetic resin is preferred. The abrasive particles can be dynamically mixed into one synthetic resin and then this mixture is dynamically melt mixed into a second synthetic resin. Alternately, the abrasive particles and two different synthetic resins can be supplied to a melt mixer then this mixture can be dynamically melt mixed. The abrasive particles can be dispersed into synthetic resin in which the abrasive particles are most compatible. Dynamically bonding a portion of the synthetic resin "A" to synthetic resin "B" is another preferred step in forming a finishing element component. Dynamically covalently bonding a portion of the synthetic resin "A" to synthetic resin "B" is another preferred step in forming a finishing element component. Dynamically melt mixing and dispersing the synthetic resin "B" into the synthetic resin "A" forming a mixture having a plurality of synthetic resin phases is another preferred step in forming a finishing element component. Dynamically forming, more preferably melt forming, a multiphase synthetic resin composition for use as synthetic resin mixture in a finishing element finishing component is preferred because low cost, high purity, good physical properties, and high quality can be achieved. Supplying a non-crosslinkable synthetic resin "A" and a crosslinkable synthetic resin "B" to a melt mixer is another preferred step in forming a finishing element component. Dynamically crosslinking synthetic resin "B" while melt mixing forming a mixture of dispersed crosslinked synthetic resin "B" particles dispersed in a continuous phase of synthetic resin "A" and the mixture having a plurality of synthetic resin phases is another preferred step in forming a finishing element component. A crosslinking agent to improve crosslinking can be preferred dynamic crosslinking of some synthetic resins. A crosslinking catalyst to improve crosslinking can be preferred dynamic crosslinking of some synthetic resins. Melt forming a finishing element component using the multiphase polymeric mixtures is preferred. Melt compounding a synthetic resin "B" in synthetic resin "A" during melt compounding forming discrete synthetic resin "B" particles in a continuous phase of synthetic resin "A" is preferred to improve dispersion and reduce costs. Melt mixing of abrasive particles in a synthetic resin "B" forming an abrasive molten polymeric matrix, and then melt mixing the abrasive molten polymeric matrix synthetic resin "A" forming discrete synthetic resin "B" particles having abrasive particles dispersed therein is preferred. By compounding without cooling, lower costs can be achieved.

Dynamically crosslinking during melt mixing can improve the physical properties of finishing element components used to finish semiconductor wafer surfaces. Dynamically crosslinking a synthetic resin forming a multiphase polymeric mixture with higher Tensile Strength as measured by ASTM D 638 to that of the same multiphase polymeric mixture in the absence of the dynamic crosslinking is preferred. Dynamically crosslinking a synthetic resin forming a multiphase polymeric mixture with higher Ultimate Tensile Strength as measured by ASTM D 638 to that of the same multiphase polymeric mixture in the absence of the dynamic crosslinking is preferred. Dynamically crosslinking a synthetic resin forming a multiphase polymeric mixture with higher Ultimate Elongation as measured by ASTM D 638 to that of the same multiphase polymeric mixture in the absence of the dynamic crosslinking is preferred. Dynamically crosslinking a synthetic resin forming a multiphase polymeric mixture with higher toughness to that of the same multiphase polymeric mixture in the absence of the dynamic crosslinking is preferred. Dynamically crosslinking a synthetic resin forming a multiphase polymeric mixture with higher Fatigue Endurance as measured by ASTM D 671 to that of the same multiphase polymeric mixture in the absence of the dynamic crosslinking is preferred. Dynamic crosslinking improving a plurality of these properties is especially preferred. Finishing elements having these improved physical properties can improve finishing.

Dynamically reacting a first synthetic resin with a second synthetic resin during melt mixing can improve the physical properties of finishing element components used to finish semiconductor wafer surfaces. Dynamically reacting a first synthetic resin with a second synthetic resin forming a multiphase polymeric mixture with higher Tensile Strength as measured by ASTM D 638 to that of the same multiphase polymeric mixture in the absence of a dynamic reaction between the two synthetic resins is preferred. Dynamically reacting a first synthetic resin with a second synthetic resin forming a multiphase polymeric mixture with higher Ultimate Tensile Strength as measured by ASTM D 638 to that of the same multiphase polymeric mixture in the absence of a dynamic reaction between the two synthetic resins is preferred. Dynamically reacting a first synthetic resin with a second synthetic resin forming a multiphase polymeric mixture with higher Ultimate Elongation as measured by ASTM D 638 to that of the same multiphase polymeric mixture in the absence of the a dynamic reaction between the two synthetic resins is preferred. Dynamically reacting a first synthetic resin with a second synthetic resin forming a multiphase polymeric mixture with higher toughness to that of the same multiphase polymeric mixture in the absence of a dynamic reaction between the two synthetic resins is preferred. Dynamically reacting a first synthetic resin with a second synthetic resin forming a multiphase polymeric mixture with higher the Fatigue Endurance as measured by ASTM D 671 to that of the same multiphase polymeric mixture in the absence of the a dynamically reaction between the two synthetic resins is preferred. A dynamic reaction between the two different synthetic resins improving a plurality of these properties is especially preferred. Finishing elements having these improved physical properties can improve finishing.

Dynamically vulcanizing the polymer in synthetic resin particles is preferred and dynamically fully vulcanizing the polymer in the synthetic resin particles is more preferred. U.S. Pat. No. 3,758,643 to Fischer, U.S. Pat. No. 4,130,534 to Coran, et al. and U.S. Pat. No. 4,355,139 to Coran, et al. are included herein by reference in their entirety for guidance and modification by those skilled in the arts. Dynamically vulcanizing the polymeric synthetic resin particles dispersed in a continuous phase of synthetic resin can improve finishing characteristics of the finishing element.

Melt forming the finishing element components is preferred. Molding is a preferred type of melt forming. Injection molding is a preferred type of molding. Compression molding is a preferred type of molding. Coinjection molding is a preferred type of melt forming. Melt injection molding is a preferred method of molding. Melt coinjection molding is a preferred form of coinjection molding. U.S. Pat. No. 4,385,025 to Salerno et al. provides nonlimiting illustrative guidance for injection molding and coinjection molding and is included herein by reference in its entirety. Melt molding can form components with very tight tolerances. Injection molding and coinjection molding are offer low cost, good resistance to contamination, and very tight tolerances. Extrusion is a preferred form of melt forming. Extrusion can be low cost and have good tolerances. Preferred finishing element components include finishing element finishing layers, finishing element sublayers, and discrete stiffening members. Melt forming finishing elements and/or components thereof with a thermoplastic multiphase polymeric composition which can be recycled is especially preferred to help reduce costs and improve performance.

Each of these forming process can be low cost and produce finishing elements with tight tolerances.

With dynamic melt forming of the synthetic resin particles, the cost of molding, demolding, and handling a predetermined shape is eliminated. Further, by reducing the number of times the synthetic resin particles are exposed to handling, unwanted foreign contamination is reduced or eliminated further increasing the quality of the resultant finishing elements.

Workpiece

A workpiece needing finishing is preferred. A semiconductor wafer is a preferred workpiece. A semiconductor wafer having some regions of high conductivity and some regions of low conductivity are even more preferred. A homogeneous surface composition is a workpiece surface having one composition throughout and is preferred for some applications. A workpiece needing polishing is preferred. A workpiece needing planarizing is especially preferred. A workpiece having a microelectronic surface is preferred. A workpiece surface having a heterogeneous surface composition is preferred. A heterogeneous surface composition has different regions with different compositions on the surface; further, the heterogeneous composition can change with the distance from the surface. Thus finishing can be used for a single workpiece whose surface composition changes as the finishing process progresses. A workpiece having a microelectronic surface having both conductive regions and nonconductive regions is more preferred and is an example of a preferred heterogeneous workpiece surface. Illustrative examples of conductive regions can be regions having copper or tungsten and other known conductors, especially metallic conductors. Metallic conductive regions in the workpiece surface consisting of metals selected from the group consisting of copper, aluminum, and tungsten or combinations thereof are particularly preferred. A semiconductor device is a preferred workpiece. A substrate wafer is a preferred workpiece. A semiconductor wafer having a polymeric layer requiring finishing is!preferred because a lubricating aid can be particularly helpful in reducing unwanted surface damage to the softer polymeric surfaces. An example of a preferred polymer is a polyimide. Polyimide polymers are commercially available from E. I. DuPont Co. in Wilmington, Del. A semiconductor having a interlayer dielectric needing finishing is preferred.

This invention is particularly preferred for workpieces requiring a highly flat surface. Finishing a workpiece surface to a surface to meet the specified semiconductor industry circuit design rule is preferred and finishing a workpiece surface to a surface to meet the 0.35 micrometers feature size semiconductor design rule is more preferred and finishing a workpiece surface to a surface to meet the 0.25 micrometers feature size semiconductor design rule is even more preferred and finishing a workpiece surface to a to meet the 0.18 micrometers semiconductor design rule is even more particularly preferred. An electronic wafer finished to meet a required surface flatness of the wafer device rule to be used in the manufacture of ULSIs (Ultra Large Scale Integrated Circuits) is a particularly preferred workpiece made with a method according to preferred embodiments of this invention. The design rules for semiconductors are generally known to those skilled in the art. Guidance can also be found in the "The National Technology Roadmap for Semiconductors" published by SEMATECH in Austin, Tex.

A semiconductor wafer having a diameter of at least 200 mm is preferred and a semiconductor wafer having a diameter of at least 300 mm is more preferred.

Finishing Composition

Finishing compositions are generally known for fixed abrasive finishing. A chemical mechanical polishing slurry can also be used as a finishing composition. Alternately, a finishing composition can be modified by those skilled in the art by removing the abrasive particles to form a finishing composition free of abrasive particles. A finishing composition substantially free of abrasive particles is preferred and a finishing composition free of abrasive particles is more preferred. Finishing compositions have their pH adjusted carefully, and generally comprise other chemical additives used to effect chemical reactions and/other surface changes to the workpiece. A finishing composition having dissolved chemical additives is particularly preferred. Illustrative examples of preferred dissolved chemical additives include dissolved acids, bases, buffers, oxidizing agents, reducing agents, stabilizers, and chemical reagents. A finishing composition having a chemical which substantially reacts with material from the workpiece surface being finished is particularly preferred. A finishing composition having a chemical which selectively chemically reacts with only a portion of the workpiece surface is particularly preferred. A finishing composition having a chemical which preferentially chemically reacts with only a portion of the workpiece surface is particularly preferred.

Some illustrative nonlimiting examples of polishing slurries which can be modified and/or modified by those skilled in the art are now discussed. An example slurry comprises water, a solid abrasive material and a third component selected from the group consisting of $HNO_3$, $H_2SO_4$, and $AgNO_3$ or mixtures thereof. Another polishing slurry comprises water, aluminum oxide, and hydrogen peroxide mixed into a slurry. Other chemicals such as KOH (potassium hydroxide) can also be added to the above polishing slurry. Still another illustrative polishing slurry comprises $H_3PO_4$ at from about 0.1% to about 20% by volume, $H_2O_2$ at from 1% to about 30% by volume, water, and solid abrasive material. Still another polishing slurry comprises an oxidizing agent such as potassium ferricyanide, an abrasive such as silica, and has a pH of between 2 and 4. Still another polishing slurry comprises high purity fine metal oxides particles uniformly dispersed in a stable aqueous medium. Still another polishing slurry comprises a colloidal suspension of $SiO_2$ particles having an average particle size of between 20 and 50 nanometers in alkali solution, demineralized water, and a chemical activator. U.S. Pat. No. 5,209,816 to Yu et al., U.S. Pat. No. 5,354,490 to Yu et al., U.S. Pat. No. 5,5408, 810 to Sandhu et al. issued in 1996, U.S. Pat. No. 5,516,346 to Cadien et al., U.S. Pat. No. 5,527,423 to Neville et al., U.S. Pat. No. 5,622,525 to Haisma et al., and U.S. Pat. No. 5,645,736 to Allman comprise illustrative nonlimiting examples of slurries contained herein by reference in their entirety for further general guidance and modification by those skilled in the arts. Commercial CMP polishing slurries are also available from Rodel Manufacturing Company in Newark, Del. Application WO 98/18159 to Hudson gives general guidance for those skilled in the art for modifying current slurries to produce an abrasive free finishing composition.

In a preferred mode, the finishing composition is free of abrasive particles. However, as the fixed abrasive finishing element wears down during finishing, some naturally worn fixed abrasive particles can be liberated from the fixed abrasive finishing element and thus can temporarily be present in the finishing composition until drainage or removal.

A lubricating aid which is water soluble is can be added to the finishing composition and is preferred for some applications. A lubricating aid which has a different solubility in water at different temperatures is more preferred. A degradable finishing aid, more preferably a lubricating aid, is also preferred and a biodegradable finishing aid, more preferably a lubricating aid, is even more preferred. An environmentally friendly finishing aid, more preferably a lubricating aid, is particularly preferred. A water based lubricant formed with water which has low sodium content is also preferred because sodium can have a adverse performance effect on the preferred semiconductor parts being made. A lubricant free of sodium is a preferred lubricant. As used herein a lubricant fluid free of sodium means that the sodium content is below the threshold value of sodium which will adversely impact the performance of a semiconductor wafer or semiconductor parts made therefrom. A finishing aid, more preferably a lubricating aid, free of sodium is preferred. As used herein a finishing aid free of sodium means that the sodium content is below the threshold value of sodium which will adversely impact the performance of a semiconductor wafer or semiconductor parts made therewith.

Operative Finishing Motion

Chemical mechanical finishing during operation has the finishing element in operative finishing motion with the surface of the workpiece being finished. A relative lateral parallel motion of the finishing element to the surface of the workpiece being finished is an operative finishing motion. Lateral parallel motion can be over very short distances or macro-distances. A parallel circular motion of the finishing element finishing surface relative to the workpiece surface being finished can be effective. A tangential finishing motion can also be preferred. U.S. Pat. No. 5,177,908 to Tuttle, U.S. Pat. No. 5,234,867 to Schultz et al., U.S. Pat. No. 5,522,965 to Chisholm et al., U.S. Pat. No. 5,735,731 to Lee, and U.S. Pat. No. 5,962,947 to Talieh, and U.S. Pat. No. 5,759,918 to Hoshizaki et al. comprise illustrative nonlimiting examples of operative finishing motion contained herein by reference in their entirety herein for further general guidance of those skilled in the arts.

Some illustrative nonlimiting examples of preferred operative finishing motions for use in the invention are also discussed. This invention has some particularly preferred operative finishing motions of the workpiece surface being finished and the finishing element finishing surface. Moving the finishing element finishing surface in an operative finishing motion to the workpiece surface being finished is a preferred example of an operative finishing motion. Moving the workpiece surface being finished in an operative finishing motion to the finishing element finishing surface is a preferred example of an operative finishing motion. Moving the finishing element finishing surface in a parallel circular motion to the workpiece surface being finished is a preferred example of an operative finishing motion. Moving the workpiece surface being finished in a parallel circular motion to the finishing element finishing surface is a preferred example of an operative parallel. Moving the finishing element finishing surface in a parallel linear motion to the workpiece surface being finished is a preferred example of an operative finishing motion. Moving the workpiece surface being finished in a parallel linear motion to the finishing element finishing surface is a preferred example of an operative parallel. The operative finishing motion performs a significant amount of the polishing and planarizing in this invention.

High speed finishing of the workpiece surface with fixed abrasive finishing elements can cause surface defects in the workpiece surface being finished at higher than desirable rates because of the higher forces generated. As used herein, high speed finishing involves relative operative motion having an equivalent linear velocity of greater than 300 feet per minute and low speed finishing involves relative operative motion having an equivalent linear velocity of at most 300 feet per minute. The relative operative speed is measured between the finishing element finishing surface and the workpiece surface being finished. Supplying a lubricating aid between the interface of finishing element finishing surface and the workpiece surface being finished when high speed finishing is preferred to reduce the level of surface defects. Supplying a lubricating aid between the interface of a fixed abrasive cylindrical finishing element and a workpiece surface being finished is a preferred example of high speed finishing. Supplying a lubricating aid between the interface of a fixed abrasive belt finishing element and a workpiece surface being finished is a preferred example of high speed finishing. An operative finishing motion which maintains substantially constant instantaneous relative velocity between the finishing element and all points on the semiconductor wafer is preferred for some finishing equipment. An operative finishing motion which maintains substantially different instantaneous relative velocity between the finishing element and some points on the semiconductor wafer is preferred for some finishing equipment. Nonlimiting illustrative examples of some different finishing elements and a cylindrical finishing element are found in patents U.S. Pat. No. 5,735,731 to Lee, U.S. Pat. No. 5,762,536 to Pant, and U.S. Pat. No. 5,759,918 to Hoshizaki et al. and which can be modified by those skilled in the art as appropriate. U.S. Pat. No. 5,735,731 to Lee, U.S. Pat. No. 5,762,536 to Pant, and U.S. Pat. No. 5,759,918 to Hoshizaki et al. are included herein by reference in their entirety.

Platen

The platen is generally a stiff support structure for the finishing element. The platen surface facing the workpiece surface being finished is parallel to the workpiece surface being planarized and is flat and generally made of metal. The platen reduces flexing of the finishing element by supporting the finishing element, optionally a pressure distributive element can also be used. The platen surface during polishing is generally in operative finishing motion to the workpiece surface being finished. The platen surface can be static while the workpiece surface being finished is moved in an operative finishing motion. The platen surface can be moved in a parallel motion fashion while the workpiece surface being finished is static. Optionally, both the platen surface and the workpiece being finished can be in motion in a way that creates operative finishing motion between the workpiece and the finishing element.

Base Support Structure

The base support structure forms structure which can indirectly aid in applying pressure to the workpiece surface being finished. It generally forms a support surface for those members attached to it directly or operatively connected to the base support structure.

Workpiece Finishing Sensor

A workpiece finishing sensor is a sensor which senses the finishing progress to the workpiece in real time so that an in situ signal can be generated. A workpiece finishing sensor is preferred. A workpiece finishing sensor which facilitates measurement and control of finishing in this invention is preferred. A workpiece finishing sensor probe which generates a signal which can be used cooperatively with the secondary friction sensor signal to improve finishing is more preferred.

The change in friction during finishing can be accomplished using technology generally familiar to those skilled in the art. The current changes related to friction changes can then be used to produce a signal to operate the finishing control subsystem. A change in friction can be detected by rotating the workpiece finishing surface with the finishing element finishing surface with electric motors and measuring power changes on one or both motors. Changes in friction can also be measured with thermal sensors. A thermistor is a non-limiting example of preferred non-optical thermal sensor. A thermal couple is another preferred non-optical thermal sensor. An optical thermal sensor is a preferred thermal sensor. A infrared thermal sensor is a preferred thermal sensor. Sensors to measure friction in workpieces being finished are generally known to those skilled in the art. Non limiting examples of methods to measure friction in friction sensor probes are described in the following U.S. Pat. No. 5,069,002 to Sandhu et al., U.S. Pat. No. 5,196,353 to Sandhu, U.S. Pat. No. 5,308,438 to Cote et. al., U.S. Pat. No. 5,595,562 to Yau et al., U.S. Pat. No. 5,597,442 to Chen, U.S. Pat. No. 564050 to Chen, and U.S. Pat. No. 5,738,562 to Doan et al. and are included by reference herein in their entirety for guidance and can be advantageously modified by those skilled in the art for use in this invention. Thermal sensors are available commercially from Terra Universal, Inc. in Anaheim, Calif. and Hart Scientific in American Fork, Utah. Measuring the changes in friction at the interface between the workpiece being finished and the finishing element finishing surface to generate an in situ signal for control is particularly preferred because the it can be effectively combined with a secondary friction sensor further improve finishing control.

A workpiece finishing sensor for the workpiece being finished is preferred. A sensor for the workpiece being finished selected from the group consisting of friction sensors, thermal sensors, optical sensors, acoustical sensors, and electrical sensors is a preferred sensor for the workpiece being finished in this invention. Workpiece thermal sensors and workpiece friction sensors are non-limiting examples of preferred workpiece friction sensors. As used herein, a workpiece friction sensor can sense the friction between the interface of the workpiece being finished and the finishing element finishing surface during operative finishing motion.

Additional non-limiting preferred examples of workpiece finishing sensors will now be discussed. Preferred optical workpiece finishing sensors are discussed. Preferred nonoptical workpiece finishing sensors are also discussed. The endpoint for planarization can be effected by monitoring the ratio of the rat e of insulator material removed over a particular pattern feature to the rate of insulator material removal over an area devoid of an underlying pattern. The endpoint can detected by impinging a laser light onto the workpiece being polished and measuring the reflected light versus the expected reflected light as an measure of the planarization process. A system which includes a device for measuring the electrochemical potential of the slurry during processing which is electrically connected to the slurry, and a device for detecting the endpoint of the process, based on upon the electrochemical potential of the slurry, which is responsive to the electrochemical potential measuring device. Endpoint detection can be determined by an apparatus using an interferometer measuring device to direct at an unpatterned die on the exposed surface of the wafer to detect oxide thickness at that point. A semiconductor substrate and a block of optical quartz are simultaneously polished and an interferometer, in conjunction with a data processing system is then used to monitor the thickness and the polishing rate of the optical block to develop an endpoint detection method. A layer over a patterned semiconductor is polished and analyzed using optical methods to determine the end point. An energy supplying means for supplying prescribed energy to the semiconductor wafer is used to develop a detecting means for detecting a polishing end point to the polishing of film by detecting a variation of the energy supplied to the semiconductor wafer. The use of sound waves can be used during chemical mechanical polishing by measuring sound waves emanating from the chemical mechanical polishing action of the substrate against the finishing element. A control subsystem can maintain a wafer count, corresponding to how many wafers are finished and the control subsystem can regulate the backside pressure applied to each wafer in accordance with a predetermined function such that the backside pressure increases monotonically as the wafer count increases. The above methods are generally known to those skilled in the art. U.S. Pat. No. 5,081,796 to Schultz, U.S. Pat. No. 5,439,551 to Meikle et al., U.S. Pat. No. 5,461,007 to Kobayashi, U.S. Pat. No. 5,413,941 to Koos et al., U.S. Pat. No. 5,637,185 Murarka et al., U.S. Pat. No. 5,643,046 Katakabe et al., U.S. Pat. No. 5,643,060 to Sandhu et al., U.S. Pat. No. 5,653,622 to Drill et al., and U.S. Pat. No. 5,705,435 to Chen. are included by reference in their entirety and included herein for general guidance and modification by those skilled in the art.

Changes in lubrication, particularly active lubrication, at the operative finishing interface can significantly affect finishing rates and finishing performance in ways that current workpiece finishing sensors cannot handle effectively. For instance, current workpiece finishing sensors cannot effectively monitor and control multiple real time changes in lubrication, particularly active lubrication, and changes in finishing such as finishing rates. This renders some prior art workpiece finishing sensors less effective than desirable for controlling and stopping finishing where friction is adjusted or changed in real time. Secondary friction sensor subsystems as indicated above can help to improve real time control wherein the lubrication is changed during the finishing cycle time. Preferred secondary friction sensors include optical friction sensors and non-optical friction sensors. An optical friction sensor is a preferred friction sensor. Non-limiting preferred examples of optical friction sensors are an infrared thermal sensing unit such as a infrared camera and a laser adjusted to read minute changes of movement friction sensor probe to a perturbation. A non-optical sensing friction sensor is a preferred friction sensor. Non-limiting preferred examples of non-optical friction sensors include thermistors, thermocouples, diodes, thin conducting films, and thin metallic conducting films. Electrical performance versus temperature such as conductivity, voltage, and resistance is measured. Those skilled in the thermal measurement arts are generally familiar with non-optical thermal sensors and their use. A change in friction can be detected by rotating the friction sensor in operative friction contact with the finishing element finishing surface with electric motors and measuring current changes on one or both motors. The current changes related to friction changes can then be used to produce a signal to operate the friction sensor subsystem. Further details of secondary friction sensors and their use is found in a newly filed Patent Application with private serial number IDTL11599 filed on Nov. 5, 1999 with PTO Ser. No. 09/435,181 and having the title "In Situ Friction Detector for finishing for finishing semiconductor wafers" and it is included in its entirety for general guidance and modification of those skilled in the art. Where the material changes with depth during the finishing of workpiece being finished, one can monitor friction changes with a secondary friction sensor having dissimilar materials even with active lubrication (or changing lubrication) and therefore readily detect the end point or control the finishing in situ. As an additional example, the finishing rate can be correlated with the instantaneous lubrication at the operative finishing interface, a mathematical equation can be developed to monitor finishing rate with instantaneous lubrication information from the secondary sensor and the processor then in real time calculates finishing rates and indicates the end point to the controller.

Process Control Parameters

Preferred process control parameters include those control parameters which can be changed during processing and affect workpiece finishing. Control of the operative finishing motion is a preferred process control parameter. Examples of preferred operative finishing motions include relative velocity, pressure, and type of motion. Examples of preferred types of operative finishing motion include tangential motion, planar finishing motion, linear motion, vibrating motion, oscillating motion, and orbital motion. Finishing temperature is a preferred process control parameter. Finishing temperature can be controlled by changing the heat supplied to the platen or heat supplied to the finishing composition. Alternately, friction can also change the finishing temperature and can be controlled by changes in lubrication, applied pressure during finishing, and relative operative finishing motion velocity. Changes in lubricant can be effected by changing finishing composition(s) and/or feed rate(s). A preferred group of process control parameters consists of parameters selected from the group consisting of wafer relative velocity, platen velocity, polishing pattern, finishing temperature, force exerted on the operative finishing interface, finishing composition, finishing composition feed rate, and finishing pad conditioning.

Processor

A processor is preferred to help evaluate the workpiece finishing sensor information. A processor can be a microprocessor, an ASIC, or some other processing means. A processor preferably has computational and digital capabilities. Non limiting examples of processing information include use of various mathematical equations, calculating specific parameters, memory look-up tables or databases for generating certain parameters such as historical performance or preferred parameters or constants, neural networks, fuzzy logic techniques for systematically computing or obtaining preferred parameter values. Input parameter(s) can include information on current wafers being polished such as uniformity, expected polish rates, preferred lubricants(s), preferred lubricant concentrations, entering film thickness and uniformity, workpiece pattern. Further preferred non-limiting processor capabilities including adding, subtracting, multiplying, dividing, use functions, look-up tables, noise subtraction techniques, comparing signals, and adjusting signals in real time from various inputs and combinations thereof.

Use of Information for Feedback and Controller

Controllers to control the finishing of workpieces are generally known in the art. Controllers generally use information at least partially derived from the processor to make changes to the process control parameters. A processor is preferably operatively connected to a sensor to gain current information about the process and the processor is also operatively connected to a controller which preferably controls the finishing control parameters. As used herein, a control subsystem is a combination of an operative sensor operatively connected to a processor which is operatively connected to a controller which in turn can change finishing control parameters.

An advantage of this invention is the additional degree of control it gives to the operator performing planarization and/or polishing. To better utilize this control, the use of feedback information to control the finishing control parameters is preferred and in situ control is more preferred. Controlling the finishing control parameters selected from the group consisting of finishing composition feed rates, finishing composition concentration, operative finishing motion, and operative finishing pressure is preferred to improve control of the finishing of the workpiece surface being finished and in situ control is more particularly preferred. Another preferred example of an finishing control parameter is to use a different finishing element for a different portion of the finishing cycle time such as one finishing element for the planarizing cycle time and a different finishing element for the polishing cycle time. Workpiece film thickness, measuring apparatus, and control methods are preferred methods of control. Mathematical equations including those developed based on process results can be used. Finishing uniformity parameters selected from the group consisting of Total Thickness Variation (TTV), Focal plane deviation (FPD), Within-Wafer Non-Uniformity (WIW NU), and surface quality are preferred. Average cut rate is a preferred finishing rate control parameter. Average finishing rate is a preferred finishing rate control parameter. Controlling finishing for at least a portion of the finishing cycle time with a finishing sensor subsystem to adjust in situ at least one finishing control parameter that affects finishing results is a preferred method of control finishing. Information feedback subsystems are generally known to those skilled in the art. Illustrative non limiting examples of wafer process control methods include U.S. Pat. No. 5,483,129 to Sandhu issued in 1996, U.S. Pat. No. 5,483,568 to Yano issued in 1996, U.S. Pat. No. 5,627,123 to Mogi issued in 1997, U.S. Pat. No. 5,653,622 to Drill issued in 1997, U.S. Pat. No. 5,657,123 to Mogi issued in 1997, U.S. Pat. No. 5,667,629 to Pan issued in 1997, and U.S. Pat. No. 5,695,601 to Kodera issued in 1997 are included herein for guidance and modification by those skilled in the art and are included herein by reference in their entirety.

Controlling at least one of the finishing control parameters based on using secondary friction sensor information combined with workpiece finishing sensor information is preferred and controlling at least two of the finishing control parameters using a secondary friction sensor information combined with workpiece finishing sensor information is more preferred. Using an electronic finishing sensor subsystem to control the finishing control parameters is preferred. Feedback information selected from the group consisting of finishing rate information and product quality information such as surface quality information is preferred. Non-limiting preferred examples of process rate information include polishing rate, planarizing rate, and workpiece finished per unit time. Non-limiting preferred examples of quality information include first pass first quality yields, focal plane deviation, total thickness variation, measures of non uniformity. Non-limiting examples particularly preferred for electronics parts include Total Thickness Variation (TTV), Focal plane deviation (FPD), Within-Wafer Non-Uniformity (WIW NU), and surface quality.

In situ process control systems relying on workpiece finishing sensors are generally known to those skilled in the CMP industry. Commercial CMP equipment advertised by Applied Materials and IPEC reference some of this equipment.

The use of lubricants in finishing, particularly boundary lubricants, in a preferred embodiment including secondary friction sensor(s), friction sensor controllers, and friction sensor subsystems are unknown in the industry.

Finishing Element Conditioning

A finishing element can be conditioned before use or between the finishing of workpieces. Conditioning a finishing element is generally known in the CMP field and generally comprises changing the finishing element finishing surface in a way to improve the finishing of the workpiece. As an example of conditioning, a finishing element having no basic ability or inadequate ability to absorb or transport a finishing composition can be modified with an abrasive finishing element conditioner to have a new texture and/or surface topography to absorb and transport the finishing composition. As a non-limiting preferred example, an abrasive finishing element conditioner having a mechanical mechanism to create a finishing element finishing surface which more effectively transports the finishing composition is preferred. The abrasive finishing element conditioner having a mechanical mechanism to create a finishing element finishing surface which more effectively absorbs the finishing composition is also preferred. An abrasive finishing element conditioner having a mechanical mechanism comprising a plurality of abrasive points which through controlled abrasion can modify the texture or surface topography of a finishing element finishing surface to improve finishing composition absorption and/or transport is preferred. An abrasive finishing element conditioner having a mechanical mechanism comprising a plurality of abrasive points comprising a plurality of diamonds which through controlled abrasion can modify the texture and/or surface topography of a finishing element finishing surface to improve finishing composition absorption and/or transport is preferred.

Modifying (or conditioning) a virgin finishing element finishing surface with a finishing element conditioner before use is generally preferred. Modifying a finishing element finishing surface with a finishing element conditioner a plurality of times is also preferred. Conditioning a virgin finishing element finishing surface can improve early finishing performance of the finishing element such as by exposing the lubricants. Modifying a finishing element finishing surface with a finishing element conditioner a plurality of times during its useful life in order to improve the finishing element finishing surface performance over the finishing cycle time by exposing new, unused lubricant, particularly new lubricant particles, is preferred. Conditioning a finishing element finishing surface a plurality of times during its useful life can keep the finishing element finishing surface performance higher over its useful lifetime by exposing fresh lubricant particles to improve finishing performance and is also preferred. Using feedback information, preferably information derived from a friction sensor probe, to select when to modify the finishing element finishing surface with the finishing element conditioner is preferred. Using feedback information, preferably information derived from a friction sensor probe, to optimize the method of modifying the finishing element finishing surface with the finishing element conditioner is more preferred. Use of feedback information is discussed further herein in other sections. When using a fixed abrasive finishing element, a finishing element having three dimensionally dispersed lubricants is preferred because during the finishing element conditioning process, material is often mechanically removed from the finishing element finishing surface and preferably this removal exposes fresh lubricants, particularly lubricant particulates, to improve finishing.

Nonlimiting examples of textures and topographies generally useful for improving transport and absorption of the finishing composition and/or finishing element conditioners and general use are given in U.S. Pat. No. 5,216,843 to Breivogel, U.S. Pat. No. 5,209,760 to Wiand, U.S. Pat. No. 5,489,233 to Cook et. al., U.S. Pat. No. 5,664,987 to Renteln, U.S. Pat. No. 5,655,951 to Meikle et al., U.S. Pat. No. 5,665,201 to Sahota, and U.S. Pat. No. 5,782,675 to Southwick and are included herein by reference in their entirety for general background and guidance and modification by those skilled in the art.

A finishing element finishing surface having a substantially self-renewing finishing surface during finishing is preferred and having a self-renewing finishing surface during finishing is more preferred. A finishing element finishing surface having a substantially self-renewing surface topography during finishing is preferred and having a self-renewing surface topography during finishing is more preferred because the self-renewing surface topography can help renew the finishing surface. As used herein, elastic deformation describes a deformation to an object that assumes its original shape after a force, causing the deformation, is removed. As used herein, plastic deformation describes a deformation to an object that assumes its newly deformed shape after a force, causing the deformation, is removed. Discrete synthetic resin particles having sufficient crosslinking can display elastic deformation during finishing of a workpiece. In other words, discrete synthetic resins which are sufficient crosslinked can be elastomeric. Thus during finishing the continuous phase of synthetic resin can undergo plastic deformation (if its yield point is exceeded) while the crosslinked discrete synthetic resin particles undergo elastic deformation. This in turn can result in the formation of useful self-renewing topographies for finishing. Finishing element finishing surface having continuous phase of synthetic resin "A" which undergoes plastic deformation during finishing and crosslinked discrete synthetic resin particles which undergo substantial elastomeric deformation is preferred for a self-renewing finishing surface. A continuous phase of synthetic resin "A" which undergoes plastic deformation during finishing and crosslinked discrete synthetic resin particles which undergoes elastomeric deformation is more preferred for a self-renewing finishing surface. With a self-renewing finishing surface, conditioning of the finishing element can generally be reduced.

Cleaning Composition

After finishing the workpiece such as a electronic wafer, the workpiece must be carefully cleaned before the next manufacturing process step. Any lubricant or abrasive particles remaining on the finished workpiece can cause quality problems later on and yield losses.

A lubricant which can be removed from the finished workpiece surface by supplying a water composition to the finished workpiece is preferred and a lubricant which can be removed from the finished workpiece surface by supplying a hot water composition to the finished workpiece is also preferred. An example of a water composition for cleaning is a water solution comprising water soluble surfactants. An effective amount of lubricant which lowers the surface tension of water to help clean abrasive and other adventitious material from the workpiece surface after finishing is particularly preferred.

A lubricant which can be removed from the finished workpiece surface is preferred for many applications. A lubricant which can be substantially removed from the finished workpiece surface by supplying deionized or pure water to the finished workpiece to substantially remove all of the lubricant is preferred and a lubricant which can be substantially removed from the finished workpiece surface by supplying hot deionized or pure water to the finished workpiece to substantially remove all of the lubricant is also preferred. A lubricant which can be removed from the finished workpiece surface by supplying deionized or pure water to the finished workpiece to completely remove the lubricant is more preferred and a lubricant which can be removed from the finished workpiece surface by supplying hot deionized or pure water to the finished workpiece in to completely remove the lubricant is also more preferred. Supplying a cleaning composition having a surfactant which removes lubricant from the workpiece surface just polished is a preferred cleaning step. A lubricant which lowers the surface tension of the water and thus helps remove any particles from the finished workpiece surface is preferred.

By using water to remove lubricant, the cleaning steps are lower cost and generally less apt to contaminate other areas of the manufacturing steps. A water cleaning based process is generally compatible with many electronic wafer cleaning process and thus is easier to implement on a commercial scale. Plasma cleaning can also be preferred for some applications.

Further Comments on Method of Operation

Some particularly preferred embodiments directed at the method of finishing are now discussed. The interface between the finishing surface finishing element and the workpiece being finished is referred to herein as the operative finishing interface.

Providing an abrasive finishing surface for finishing is preferred and providing an abrasive finishing element having a finishing surface for finishing is more preferred and providing a fixed abrasive finishing surface for finishing is even more preferred and providing a fixed abrasive finishing element having a finishing surface for finishing is even more particularly preferred. Fixed abrasive finishing generally produces less abrasive to clean from the workpiece surface that was finished. Providing the workpiece surface being finished proximate to the finishing surface is preferred and positioning the workpiece surface being finished proximate to the finishing surface is more preferred.

Supplying an operative finishing motion between the workpiece surface being finished and the finishing element finishing surface is preferred and applying an operative finishing motion between the workpiece surface being finished and the finishing element finishing surface is more preferred. The operative finishing motion creates the movement and pressure which supplies the finishing action such as chemical reactions, tribochemical reactions, and/or abrasive wear. Applying an operative finishing motion that transfers the finishing aid to the interface between the finishing surface and the workpiece surface being finished is preferred and applying an operative finishing motion that transfers the finishing aid, forming a marginally effective lubricating layer between the finishing surface and the workpiece surface being finished is more preferred and applying an operative finishing motion that transfers the finishing aid, forming a marginally effective lubricating boundary layer between the finishing surface and the workpiece surface being finished is even more preferred. The lubrication at the interface reduces the occurrence of high friction and related workpiece surface damage. Applying an operative finishing motion that transfers the finishing aid, forming a lubricating boundary layer between at least a portion of the finishing surface and the semiconductor wafer surface being finished is preferred and applying an operative finishing motion that transfers the finishing aid, forming a marginally effective lubricating layer between at least a portion of the finishing surface and the semiconductor wafer surface being finished, so that abrasive wear occurs to the semiconductor wafer surface being finished, is more preferred and applying an operative finishing motion that transfers the finishing aid, forming a marginally effective lubricating boundary layer between at least a portion of the finishing surface and the semiconductor wafer surface being finished so that tribochemical wear occur to the semiconductor wafer surface being finished is even more preferred and applying an operative finishing motion that transfers the finishing aid, differentially lubricating different regions of the heterogeneous semiconductor wafer surface being finished, is even more particularly preferred. With heterogeneous workpiece surfaces, the potential to differentially lubricate and finish a workpiece surface has high value where the differential lubrication is understood and controlled.

A finishing aid selected from the group consisting of a lubricating aid and chemically reactive aid is preferred. A finishing aid which reacts with the workpiece surface being finished is preferred and one which reacts with a portion of the workpiece surface being finished is more preferred and one which differentially reacts with heterogeneous portions of a workpiece surface being finished is even more preferred. By reacting with the workpiece surface, control of finishing rates can be improved and some surface defects minimized or eliminated. A finishing aid which reduces friction during finishing is also preferred because surface defects can be minimized.

Cleaning the workpiece surface reduces defects in the semiconductor later on in wafer processing.

Supplying a finishing aid to the workpiece surface being finished, which changes the rate of a chemical reaction, is preferred. Supplying a finishing aid to the workpiece surface being finished having a property selected from the group consisting of workpiece surface coefficient of friction, workpiece finish rate change, a heterogeneous workpiece surface having differential coefficient of friction, and a heterogeneous workpiece surface having differential finishing rate change which reduces unwanted damage to the workpiece surface is particularly preferred.

Using the method of this invention to finish a workpiece, especially a semiconductor wafer, by controlling finishing for a period of time with an electronic control subsystem connected electrically to the finishing equipment control mechanism to adjust in situ at least one finishing control parameter that affects finishing selected from the group consisting of the finishing rate and the finishing uniformity is preferred. Finishing control parameters selected from the group consisting of the finishing composition, finishing composition feed rate, finishing temperature, finishing pressure, operative finishing motion velocity and type, and finishing element type and condition change are preferred. The electronic control subsystem is operatively connected electrically to the lubrication control mechanism. The measurement and control subsystem can be separate units and/or integrated into one unit. A preferred method to measure finishing rate is to measure the change in the amount of material removed in angstroms per unit time in minutes (.ANG./min). Guidance on the measurement and calculation for polishing rate for semiconductor parts is found in U.S. Pat. No. 5,695,601 to Kodera et al. issued in 1997 and is included herein in its entirety for illustrative guidance.

An average finishing rate range is preferred, particularly for workpieces requiring very high precision finishing such as in processing electronic wafers. Average cut rate is used as a preferred metric to describe preferred finishing rates. Average cut rate is generally known to those skilled in the art. For electronic workpieces, and particularly for semiconductor wafers, a cut rate of from 100 to 25,000 Angstroms per minute on at least a portion of the workpiece is preferred and a cut rate of from 200 to 15,000 Angstroms per minute on at least a portion of the workpiece is more preferred and a cut rate of from 500 to 10,000 Angstroms per minute on at least a portion of the workpiece is even more preferred and a cut rate of from 500 to 7,000 Angstroms per minute on at least a portion of the workpiece is even more particularly preferred and a cut rate of from 1,000 to 5,000 Angstroms per minute on at least a portion of the workpiece is most preferred. A finishing rate of at least 100 Angstroms per minute for at least one of the regions on the surface of the workpiece being finished is preferred and a finishing rate of at least 200 Angstroms per minute for at least one of the materials on the surface of the workpiece being finished is preferred and a finishing rate of at least 500 Angstroms per minute for at least one of the regions on the surface of the workpiece being finished is more preferred and a finishing rate of at least 1000 Angstroms per minute for at least one of the regions on the surface of the workpiece being finished is even more preferred where significant removal of a surface region is desired. During finishing there are often regions where the operator desires that the finishing stop when reached such as when removing a conductive region (such as a metallic region) over a non conductive region (such as a silicon dioxide region). For regions where it is desirable to, stop finishing (such as the silicon dioxide region example above), a finishing rate of at most 1500 Angstroms per minute for at least one of the regions on the surface of the workpiece being finished is preferred and a finishing rate of at most 500 Angstroms per minute for at least one of the materials on the surface of the workpiece being finished is preferred and a finishing rate of at most 200 Angstroms per minute for at least one of the regions on the surface of the workpiece being finished is more preferred and a finishing rate of at most 100 Angstroms per minute for at least one of the regions on the surface of the workpiece being finished is even more preferred where significant removal of a surface region is desired. The finishing rate can be controlled by lubricants and with the process control parameters discussed herein.

The average cut rate can be measured for different materials on the surface of the semiconductor wafer being finished. For instance, a semiconductor wafer having a region of tungsten can have a cut rate of 6,000 Angstroms per minute and region of silica cut rate of 500 Angstroms per minute. As used herein, selectivity is the ratio of the cut rate of one region divided by another region. As an example, the selectivity of the tungsten region to the silica region is calculated as 6,000 Angstroms per minute divided by 500 Angstroms per minute or selectivity of tungsten cut rate to silica cut rate of 12. Lubricating properties of the finishing element can change the selectivity. It is currently believed that this is due to differential lubrication in the localized regions. Changing the lubricating properties of the finishing element to advantageously adjust the selectivity during the processing of a group of semiconductor wafer surfaces or a single semiconductor wafer surface is preferred. Changing lubricating properties of the finishing element to advantageously adjust the cut rate during the processing of a group of semiconductor wafer surfaces or a single semiconductor wafer surface is preferred. Adjusting the lubricating properties of the finishing element by changing finishing elements proximate to a heterogeneous surface to be finished is preferred. A finishing element with high initial cut rates can be used initially to improve semiconductor wafer cycle times. Changing to a finishing element having dispersed lubricants and a different selectivity ratio proximate to a heterogeneous surface to be finished is preferred. Changing to a finishing element having dispersed lubricants and a high selectivity ratio proximate to a heterogeneous surface to be finished is more preferred. In this manner customized adjustments to cut rates and selectivity ratios can be made proximate to critical heterogeneous surface regions. Commercial CMP equipment is generally known to those skilled in the art which can change finishing elements during the finishing cycle time of a semiconductor wafer surface. As discussed above, finishing a semiconductor wafer surface in only a portion of the finishing cycle time with a particular finishing element having dispersed lubricants proximate a heterogeneous surface is particularly preferred.

Using finishing of this invention to remove raised surface perturbations and/or surface imperfections on the workpiece surface being finished is preferred. Using the method of this invention to finish a workpiece, especially a semiconductor wafer, at a planarizing rate and/or planarizing uniformly according to a controllable set of operational parameters that upon variation change the planarizing rate and/or planarizing uniformity and wherein the operational parameters of at least two operational parameters are selected from the group consisting of the type of lubricant, quantity of lubricant, and time period of lubrication is preferred. Using the method of this invention to polish a workpiece, especially a semiconductor wafer, wherein an electronic control subsystem connected electrically to an operative lubrication feed mechanism adjusts in situ the subset of operational parameters that affect the planarizing rate and/or the planarizing uniformity and wherein the operational parameters are selected from the group consisting of the type of lubricant, quantity of lubricant, and time period of lubrication is preferred. The electronic control subsystem is operatively connected electrically to the operative lubrication feed mechanism.

Using the method of this invention to polish or planarize a workpiece, especially a semiconductor wafer, supplying lubrication moderated by a finishing element having at least two layers is preferred. More preferably the finishing element having at least two layers has a finishing surface layer which has a higher hardness than the subsurface layer. A finishing element having at least two layers with a finishing surface layer which has a lower hardness than the subsurface layer is preferred, particularly for polishing.

Summary

Illustrative nonlimiting examples useful technology have referenced by their patents numbers and all of these patents are included herein by reference in their entirety for further general guidance and modification by those skilled in the arts. The scope of the invention should be determined by the appended claims and their legal equivalents, rather than by the preferred embodiments and details discussed herein.

I claim:

1. A method of finishing of a semiconductor wafer surface being finished comprising the steps of:

a) providing an abrasive finishing element having an abrasive finishing surface and wherein the abrasive finishing surface comprises:

a continuous phase comprising a synthetic resin polymer "A";

unconnected, discrete synthetic resin particles comprising a synthetic resin polymer "B" having-a plurality of abrasive particles dispersed therein, the discrete synthetic resin particles comprising the synthetic resin polymer "B" being dispersed in the continuous phase of synthetic resin polymer "A"; and a compatibilizing polymer "C" coupling the discrete synthetic resin polymer "B" particles with the continuous phase of the synthetic resin polymer "A"; and the synthetic resin polymer "B" has a different the flexural modulus than that of the synthetic resin polymer "A"; and wherein b) positioning the semiconductor wafer surface being finished proximate to the abrasive finishing surface; and c) applying an operative finishing motion between the semiconductor wafer surface being finished and the abrasive finishing surface wherein the discrete synthetic resin particles are in finishing contact with the semiconductor wafer surface being finished.

2. A method of finishing of a semiconductor wafer surface being finished according to claim 1 wherein:

the synthetic resin in the synthetic resin polymer "B" particles comprises a crosslinked synthetic resin polymer "B" having the abrasive particles dispersed uniformly therein; and the synthetic resin matrix in the continuous phase comprises a thermoplastic synthetic resin matrix having finishing aids dispersed in a plurality of discrete, unconnected regions.

3. A method of finishing of a semiconductor wafer surface being finished according to claim 2 wherein finishing aids comprise lubricating aids.

4. A method of finishing of a semiconductor wafer surface being finished according to claim 1 wherein:

the synthetic resin in the synthetic resin polymer "B" particles comprises a thermoplastic synthetic resin polymer "B" having the abrasive particles dispersed uniformly therein; and the synthetic resin matrix in the continuous phase comprises a thermoplastic synthetic resin matrix having finishing aids dispersed in a plurality of discrete, unconnected regions.

5. A method of finishing of a semiconductor wafer surface being finished according to claim 1 wherein the abrasive finishing surface layer comprises the synthetic resin polymer "A" and the synthetic resin polymer "B", each having a different glass transition temperature when measured by ASTM D3418.

6. A method of finishing of a semiconductor wafer surface being finished according to claim 5 wherein the synthetic resin polymer "B" has a glass transition temperature of less than synthetic resin polymer "A" when measured by ASTM D3418.

7. A finishing element for finishing a semiconductor wafer according to claim 1 wherein the synthetic resin particles are formed during dynamic melt compounding.

8. The method of finishing according to claim 1 wherein the abrasive particles comprise synthetic resin particles.

9. The method of finishing according to claim 1 wherein the abrasive particles comprise metal oxide particles.

10. The method of finishing according to claim 1 wherein the compatibilizing polymer "C" comprises a block copolymer.

11. The method of finishing according to claim 1 wherein the compatibilizing polymer "C" comprises a graft copolymer.

12. The method of finishing according to claim 1 wherein the compatibilizing polymer "C" has a reactive functional group.

13. The method of finishing according to claim 1 wherein the discrete synthetic resin particles comprise crosslinked synthetic resin polymer "B".

14. The method of finishing according to claim 1 wherein the discrete synthetic resin particles are bound to the continuous phase of synthetic resin polymer "A" with the compatibilizing polymer "C".

15. The method of finishing according to claim 1 wherein the discrete synthetic resin particles comprising synthetic resin polymer "B" are fixedly attached to the continuous phase of synthetic resin polymer "A" and which, when physically separated from the continuous phase, result in cohesive failure.

16. The method of finishing according to claim 15 wherein the discrete synthetic resin particles are fixedly attached to the continuous phase of synthetic resin polymer and which, when physically separated from the continuous phase, results in a separation which is free of adhesive failure.

17. A finishing element having a synthetic resin layer for finishing a semiconductor wafer comprising:

a continuous phase comprising a synthetic resin matrix comprising synthetic resin polymer composition "A"; and discrete synthetic resin particles comprising synthetic resin polymer composition "B" having abrasive particles therein; the discrete synthetic resin particles being dispersed in the continuous phase of synthetic resin polymer "A"; and a polymeric compatibilizing agent "C" for compatibilizing the polymer composition "A" and the polymer composition "B"; and wherein the Shore D hardness of the synthetic resin polymer "A" in the discrete synthetic resin particle is different than the Shore D hardness of the synthetic resin polymer "B".

18. A method of finishing of a semiconductor wafer surface being finished according to claim 12 wherein the abrasive finishing surface layer comprises the synthetic resin polymer composition "A" and the synthetic resin polymer composition "B", each having a different glass transition temperature when measured by ASTM D3418.

19. A method of finishing of a semiconductor wafer surface being finished according to claim 17 wherein synthetic resin polymer "B" in the synthetic resin particles has a glass transition temperature of from 23 degrees to 110 degrees centigrade.

20. A method of finishing of a semiconductor wafer surface being finished according to claim 17 wherein the synthetic resin particles are fixedly attached to the continuous phase synthetic resin in a manner that physical separation results in cohesive failure.

21. The method of finishing according to claim 17 wherein the abrasive comprises synthetic resin particles.

22. The method of finishing according to claim 17 wherein the abrasive comprises metal oxide particles.

23. The method of finishing according to claim 17 wherein the compatibilizing polymer "C" comprises a block copolymer.

24. The method of finishing according to claim 17 wherein the compatibilizing polymer "C" comprises a graft copolymer.

25. The method of finishing according to claim 17 wherein the compatibilizing polymer "C" has a reactive functional group.

26. The method of finishing according to claim 17 wherein the synthetic resin particles are crosslinked.

27. The method of finishing according to claim 17 wherein the discrete synthetic resin particles are bound to the continuous phase of synthetic resin polymer "A" with the compatibilizing polymer "C".

* * * * *